US005189701A

United States Patent [19]

Jain

[11] Patent Number: 5,189,701

[45] Date of Patent: Feb. 23, 1993

[54] VOICE CODER/DECODER AND METHODS OF CODING/DECODING

[75] Inventor: Jaswant R. Jain, Chatsworth, Calif.

[73] Assignee: MICOM Communications Corp., Simi Valley, Calif.

[21] Appl. No.: 782,669

[22] Filed: Oct. 25, 1991

[51] Int. Cl.[5] ..... G10L 5/00; G10L 3/02; G10L 5/02

[52] U.S. Cl. ..... 381/41; 381/34; 381/36; 381/51

[58] Field of Search ..... 381/31, 34–42, 381/49–51; 395/2

[56] References Cited

U.S. PATENT DOCUMENTS

| | | | |
|---|---|---|---|
| 3,566,035 | 2/1971 | Noll et al. | 381/41 |
| 4,076,960 | 2/1978 | Buss et al. | 395/2 |
| 4,667,340 | 5/1987 | Arjmand et al. | 381/31 |
| 4,771,465 | 9/1988 | Bronson et al. | 381/36 |
| 4,827,516 | 5/1989 | Tsukahara et al. | 381/36 |
| 4,827,517 | 5/1989 | Atal et al. | 381/41 |
| 4,885,790 | 12/1989 | McAulay et al. | 381/49 |
| 4,945,565 | 7/1990 | Ozawa et al. | 381/38 |
| 5,018,200 | 5/1991 | Ozawa | 381/36 |
| 5,054,072 | 10/1991 | McAulay et al. | 381/31 |

*Primary Examiner*—Arthur G. Evans
*Assistant Examiner*—Kee M. Tung
*Attorney, Agent, or Firm*—Ellsworth R. Roston; Charles H. Schwartz

[57] ABSTRACT

The pitch frequency of voice signals in successive time frames at a voice coder may be determined as by (1) Cepstrum analysis (time between successive peak amplitudes in each time frame), (2) harmonic gap analysis (amplitude differences between peaks and troughs of the peak amplitude signals in the frequency spectrum) (3) harmonic matching, (4) filtering of the frequency signals in successive pairs of time frames and the performance of (1)-(3) on the filtered signals to provide pitch interpolation on the first frame in the pair and (5) pitch matching. The amplitude and phase of the pitch frequency and harmonic signals are determined by refined techniques to provide amplitude and phase signals with enhanced resolution. Such amplitudes are simplified digitally by (a) taking the logarithm of the frequency signals, (b) selecting the signal with the peak amplitude, (c) offsetting the amplitudes of the logarithmic signals relative to such peak amplitude, (d) companding the offset signals, (e) reducing the number of harmonics to a particular limit by eliminating selective harmonics, (f) taking a discrete cosine transform of the remaining signals and (g) digitizing the transformed signals. If the pitch frequency has a continuity within particular limits in successive time frames, the phase difference of the signals between successive time frames is provided. At a displaced voice decoder, the signal amplitudes are determined by performing, in order, the inverse of steps (g) through (a). These signals and the signals representing pitch frequency and phase are processed to recover the voice signals.

93 Claims, 5 Drawing Sheets

VOICE CODER/DECODER AND METHODS OF CODING/DECODING

This invention relates to systems for, and methods of, encoding periodic components of voice signals in a voice coder for transmission to a voice decoder displaced from the voice coder. The invention also relates to a voice decoder for decoding the encoded voice signals transmitted from the voice encoder. The invention particularly relates to a voice encoder for encoding periodic components of voice signals with an enhanced resolution to provide for an optimal restoration of the voice signals at the voice decoder and also relates to a voice decoder for recovering the voice signals.

Microprocessors are used at a sending station to convert data to a digital form for transmission to a displaced position where the data in digital form is detected and converted to its original form. Although the microprocessors are small, they have enormous processing power. This has allowed sophisticated techniques to be employed by the microprocessor at the sending station to encode the data into digital form and to be employed by the microprocessor at the receiving station to decode the digital data and convert the digital data to its original form. The data transmitted may be through facsimile equipment at the transmitting and receiving stations and may be displayed as in a television set at the receiving station. As the processing power of the microprocessors has increased even as the size of the microprocessors has decreased, the sophistication in the encoding and decoding techniques, and the resultant resolution of the data at the receiving station, has become enhanced.

In recent years as the microprocessors have become progressively sophisticated in their ability to process data, it has become increasingly desirable to be able to transmit voice information in addition to data. For example, in telephone conferences, it has been desirable to transmit documents such as letters and written reports and analyses and to provide a discussion concerning such reports.

It has been found that it has been difficult to convert voice signals to a compressed digital form which can be transmitted to a receiving station to obtain a faithful reproduction of the speaker's voice at the receiving station. This results from the fact that the frequencies and amplitudes of a speaker's voice are constantly changing. This is even true during the time that the speaker is uttering a vowel, such as the letter "a", particularly since the duration of such vowels tends to be prolonged and speakers do not tend to talk in a monotone.

A considerable effort has been made, and a considerable amount of money has been expended, in recent years to provide systems for, and methods of, coding voice signals to a compressed digital form at a transmitting station, transmitting such digital signals to a receiving station and decoding such digital signals at the receiving station to reproduce the voice signals. As a result of such efforts and money expenditures, considerable progress has been made in providing a faithful reproduction of voice signals at the receiving station. However, in spite of such progress, a faithful reproduction of voice signals at the receiving station remains elusive. Listeners at the receiving station still do not hear the voice of a speaker at the transmitting station without inwardly feeling, or outwardly remarking, that there is a considerable distortion in the speaker's voice. This has tended to detract from the ability of the participants at the two (2) displaced stations to communicate meaningfull with each other.

This invention provides a system which converts voice signals into a compressed digital form in a voice coder to represent pitch frequency and pitch amplitude and the amplitudes and phases of the harmonic signals such that the voice signals can be reproduced at a voice decoder without distortion. The invention also provides a voice decoder which operates on the digital signals to provide such a faithful reproduction of the voice signals. The voice signals are coded at the voice coder in real time and are decoded at the voice decoder in real time.

In one embodiment of the invention, a new adaptive Fourier transform encoder encodes periodic components of speech signals and decodes the encoded signals. In the apparatus, the pitch frequency of voice signals in successive time frames at the voice coder may be determined as by (1) Cepstrum analysis (e.g. the time between successive peak amplitudes in each time frame, (2) harmonic gap analysis (e.g. the amplitude differences between the peaks and troughs of the peak amplitude signals of the frequency spectrum) (3) harmonic matching, (4) filtering of the frequency signals in successive pairs of time frames and the performance of steps (1), (2) and (3) on the filtered signals to provide pitch interpolation on the first frame in the pair, and (5) pitch matching.

The amplitude and phase of the pitch frequency signals and harmonic signals are determined by techniques refined relative to the prior art to provide amplitude and phase signals with enhanced resolution. Such amplitudes may be converted to a simplified digital form by (a) taking the logarithm of the frequency signals, (b) selecting the signal with the peak amplitude, (c) offsetting the amplitudes of the logarithmic signals relative to such peak amplitude, (d) companding the offset signals, (e) reducing the number of harmonics to a particular limit by eliminating alternate high frequency harmonics, (f) taking a discrete cosine transform of the remaining signals and (g) digitizing the signals in such transform. If the pitch frequency has a continuity within particular limits in successive time frames, the phase difference of the signals between successive time frames is provided.

At a displaced voice decoder, the signal amplitudes are determined by performing, in order, the inverse of steps (g) through (a). These signals and the signals representing pitch frequency and phase are processed to recover the voice signals without distortion.

Figure 10:
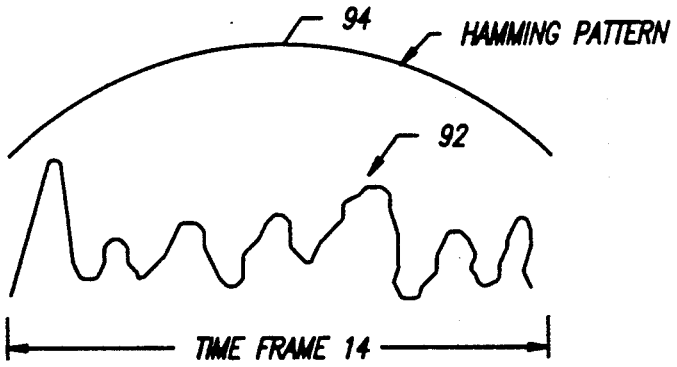
FIG. 10 is a diagram illustrating one step involving the use of a Hamming window analysis in precisely determining the characteristics of each harmonic frequency in the voice signals in each time frame.
Figure 12:
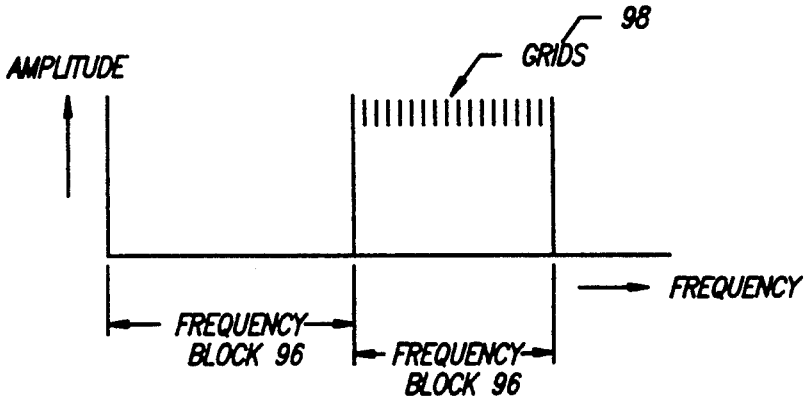
Figure 11:
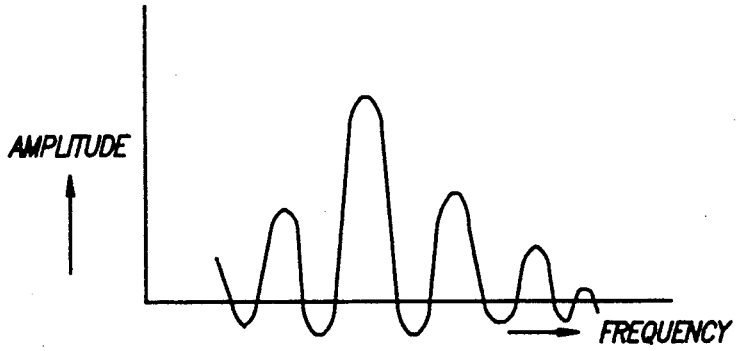
Figure 13:
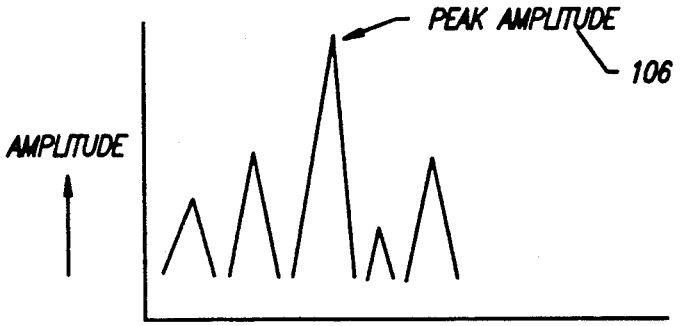
Figure 14:
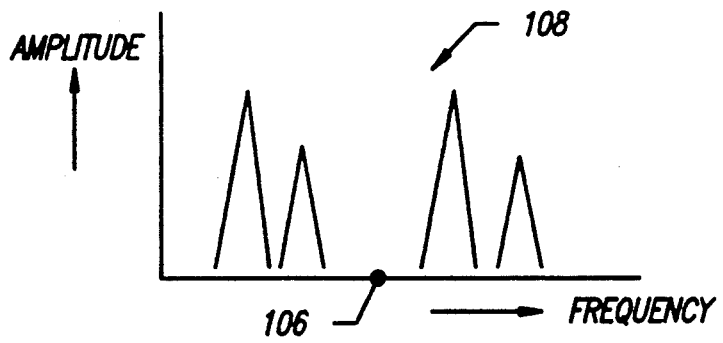
Figure 15:
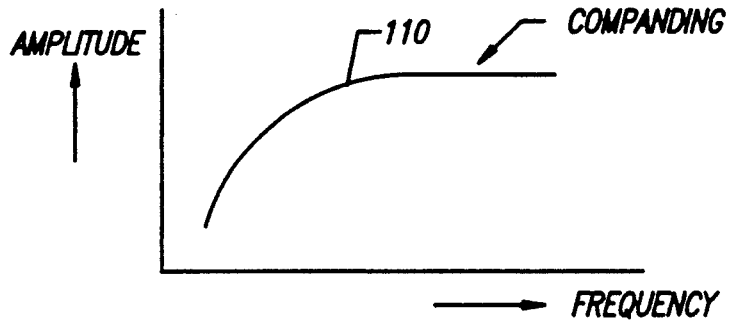
Figure 16:
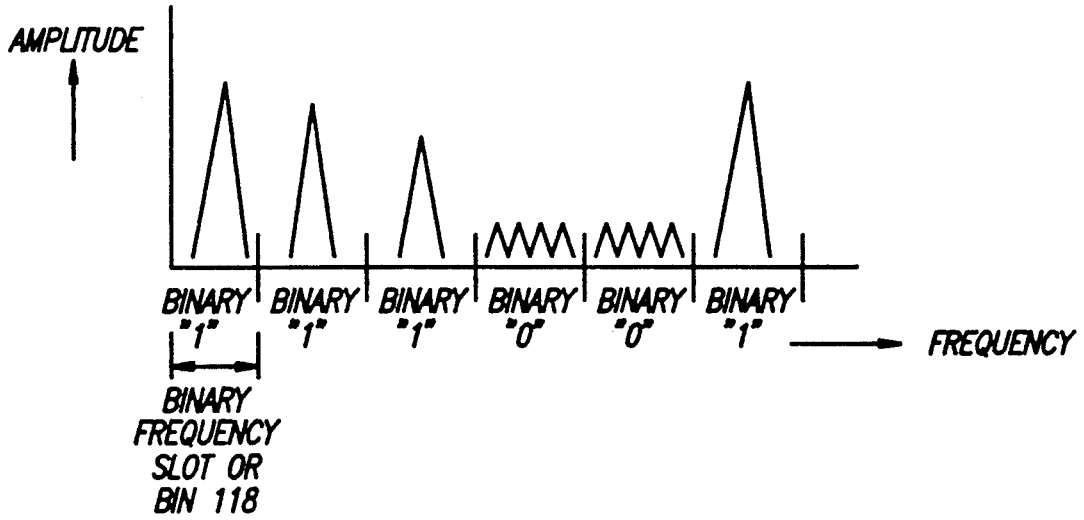

FIG. 11 indicates the amplitude pattern of an individual frequency as a result of using the Hamming window analysis shown in FIG. 10;

FIG. 12 illustrates the techniques used to determine the amplitude and phase of each harmonic in the voice signals in each time frame with greater precision than in the prior art;

FIG. 13 illustrates the relative amplitude values of the logarithms of the different harmonics in the voice signals in each time frame and the selection of the harmonic with the peak amplitude;

FIG. 14 indicates the logarithmic harmonic signals of FIG. 13 after the amplitudes of the different harmonics have been converted to indicate their amplitude difference relative to the peak amplitude shown in FIG. 13;

FIG. 15 schematically indicates the effect of a companding operation on the signals shown in FIG. 14; and FIG. 16 illustrates how the frequency signals in different frequency slots or bins in each time frame are analyzed to provide voiced (binary "1") and unvoiced (binary "0") signals in such time frame.

Figure 6:
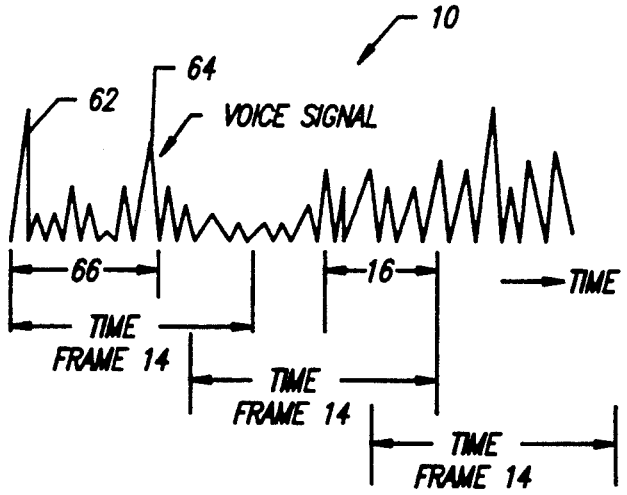
FIG. 6 is a schematic diagram of the voice signals to be encoded in successive time frames and further illustrates how the time frames overlap.

In one embodiment of the invention, voice signals are indicated at 10 in FIG. 6. As will be seen, the voice signals are generally variable with time and generally do not have a fully repetitive pattern. The system of this invention includes a block segmentation stage 12 (FIG. 1) which separates the signals into time frames 14 (FIG. 6) each preferably having a suitable time duration such as approximately thirty two milliseconds (32 ms.). Preferably the time frames 14 overlap by a suitable period of time such as approximately twelve milliseconds (12 ms.) as indicated at 16 in FIG. 1. The overlap 16 is provided in the time frames 14 because portions of the voice signals at the beginning and end of each time frame 14 tend to become distorted during the processing of the signals in the time frame relative to the portions of the signals in the middle of the time frame.

Figure 1:
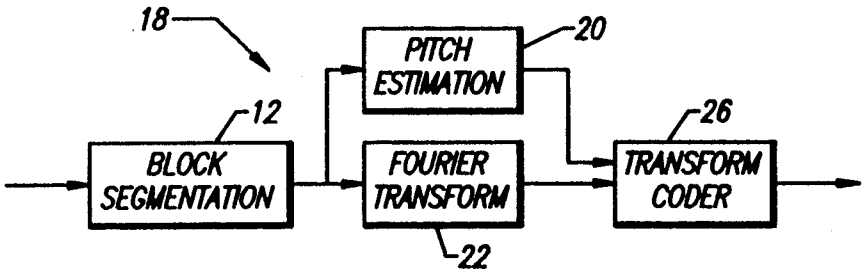
FIG. 1 is a simplified block diagram of a system at a voice encoder for encoding voice signals into a digital form for transmission to a voice decoder.

The block segmentation stage 12 in FIG. 1 is included in a voice coder generally indicated at 18 in FIG. 1. A pitch estimation stage generally indicated at 20 estimates the pitch or fundamental frequency of the voice signals in each of the time frames 14 in a number of different ways each providing an added degree of precision and/or confidence to the estimation. The stages estimating the pitch frequency in different ways are shown in FIG. 4.

Figure 2:
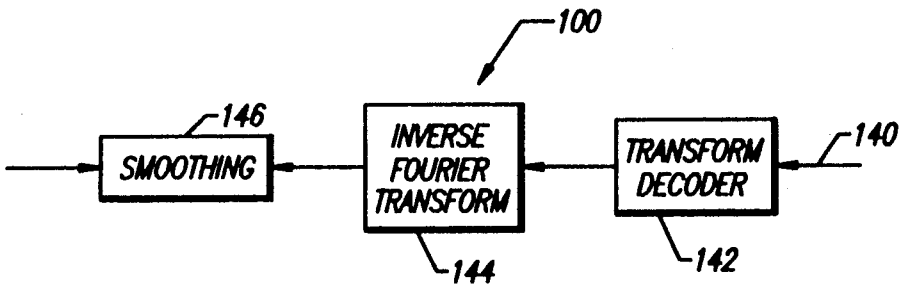
FIG. 2 is a simplified block diagram of a system at a voice decoder for receiving the digital signals from the voice encoder and for decoding the digital signals to reproduce the voice signals.
Figure 3:
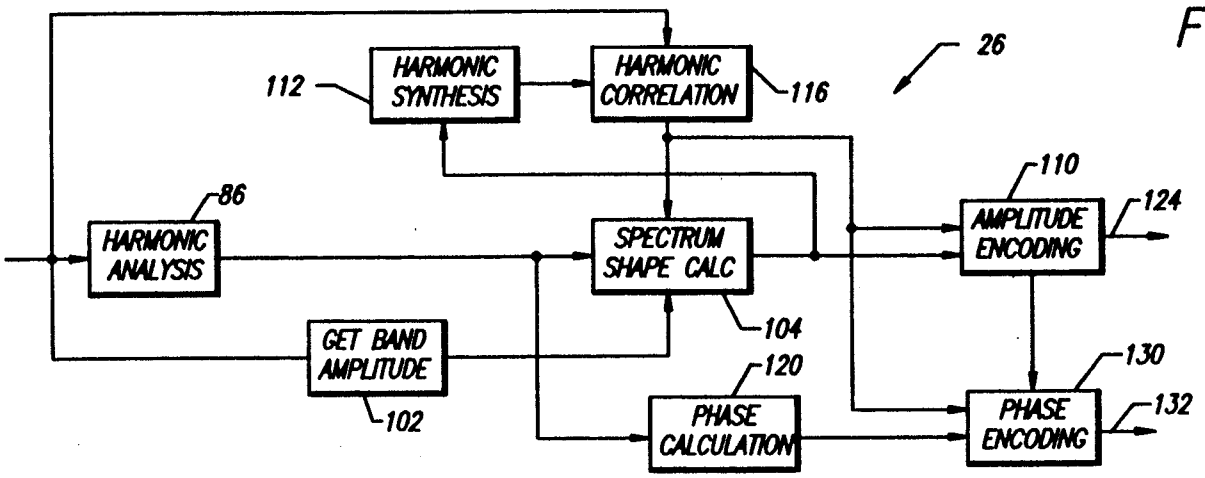
FIG. 3 is a block diagram in increased detail of a portion of the voice encoder shown in FIG. 1 and shows how the voice encoder determines and encodes the amplitudes and phases of the harmonics in successive time frames.

The voice signals in each time frame 14 also pass to stage 22 which provides a frequency transform such as a Fourier frequency transform on the signals. The resultant frequency signals are generally indicated at 24 in FIG. 7. The signals 24 in each time frame 14 then pass to a coder stage 26. The coder stage 26 determines the amplitude and phase of the different frequency components in the voice signals in each time frame 14 and converts these determinations to a binary form for transmission to a voice decoder such a shown in FIGS. 2 and 5. The stages for providing the determination of amplitudes and phases and for converting these determinations to a form for transmission to the voice decoder of FIG. 2 are shown in FIG. 3.

Figure 4:
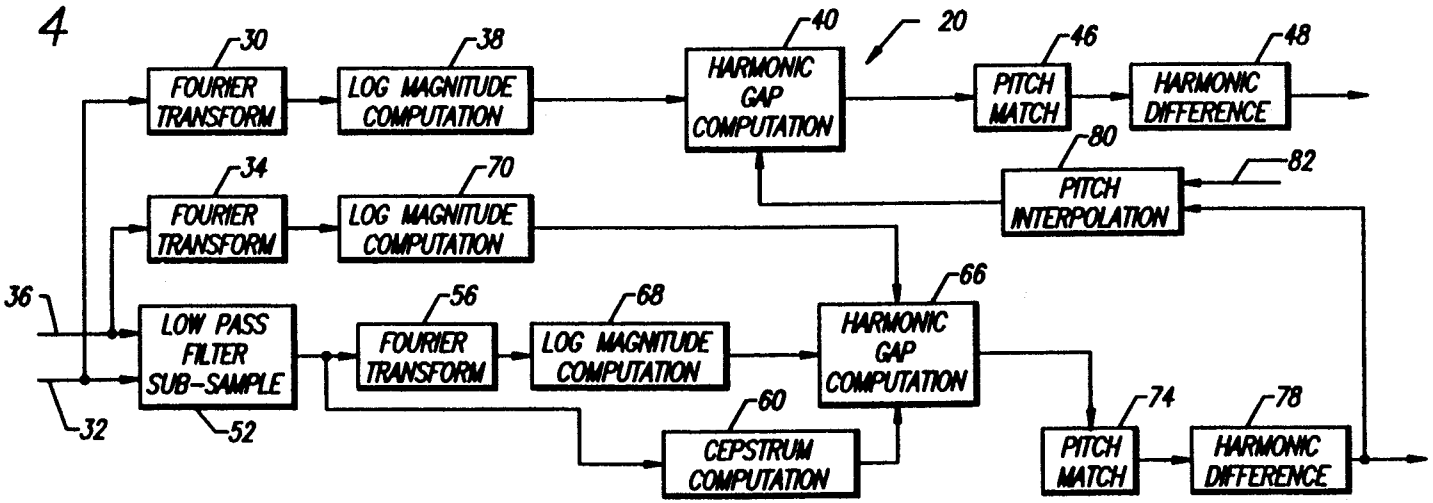
FIG. 4 is a block diagram of another portion of the voice decoder and shows how the voice encoder determines the pitch frequency of the voice signals in the successive time frames.

FIG. 4 illustrates in additional detail the pitch estimation stage 20 shown in FIG. 1. The pitch estimation stage 20 includes a stage 30 for receiving the voice signals on a line 32 in a first one of the time frames 14 and for performing a frequency transform on such voice signals as by a Fourier frequency transform. Similarly, a stage 34 receives the voice signals on a line 36 in the next time frame 14 and performs a frequency transform such as by a Fourier frequency transform on such voice signals. In this way, the stage 30 performs frequency transforms on the voice signals in alternate ones of the successive time frames 14 and the stage 34 performs frequency transforms on the voice signals in the other ones of the time frames. The stages 30 and 34 perform frequency transforms such as Fourier frequency transforms to produce signals at different frequencies corresponding to the signals 24 in FIG. 7.

Figure 7:
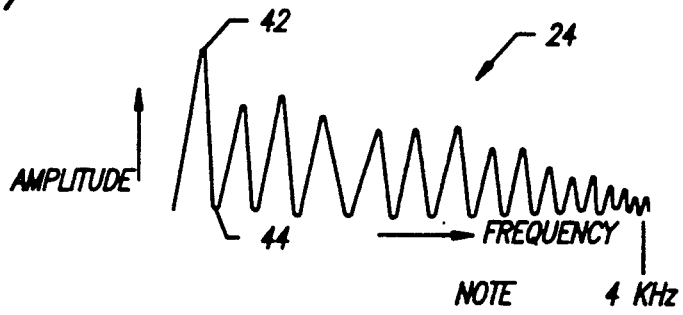
FIG. 7 is a diagram schematically illustrating signals produced in a typical time frame to represent different frequencies after the voice signals in the time frame have been frequency transformed as by a Fourier frequency analysis.

The frequency signals from the stage 30 pass to a stage 38 which performs a logarithmic calculation on the magnitudes of these frequency signals. This causes the magnitudes of the peak amplitudes of the signals 24 to be closer to one another than if the logarithmic calculation were not provided. Harmonic gap measurements in a stage 40 are then provided on the logarithmic signals from the stage 38 The harmonic gap calculations involve a determination of the difference in amplitude between the peak of each frequency signal and the trough following the signal. This is illustrated in FIG. 7 at 42 for a peak amplitude for one of the frequency signals 24 and at 44 for a trough following the peak amplitude 40. In determining the difference between the peak amplitudes such as the amplitude 42 and the troughs such as the trough 44, the positions in the frequency spectrum around the peak amplitude and the trough are also included in the determination. The frequency signal providing the largest difference between the peak amplitude and the following trough in the frequency signals 24 constitutes one estimation of the pitch frequency of the voice signals in the time frame 14. This estimation is where the peak amplitude of such frequency signal occurs.

As will be appreciated, female voices are higher in pitch frequency than male voices. This causes the number of harmonic frequencies in the voice signals of females to be lower than those in the voice signals of male voices. However, since the pitch frequency in the voice signals of a male is low, the spacing in time between successive signals at the pitch frequency in each time frame 14 may be quite long. Because of this, only two (2) or three (3) periods at the pitch frequency may occur in each time frame 14 for a male voice. This limits the ability to provide accurate determinations of pitch frequency for a male voice.

In providing a harmonic gap calculation, the stage 40 always provides a determination with respect to the voice frequencies of voices whether the voice is that of a male or a female. However, when the voice is that of a female, the stage 40 provides an additional calculation with particular attention to the pitch frequencies normally associated with female voices. This additional calculation is advantageous because there are an increased number of signals at the pitch frequency of female voices in each time frame 14, thereby providing for an enhancement in the estimation of the pitch frequency when an additional calculation is provided in the stage 40 for female voices.

The signals from the stage 40 for performing the harmonic gap calculation pass to a stage 46 (FIG. 41) for providing a pitch match with a restored harmonic synthesis. This restored harmonic synthesis will be described in detail subsequently in connection with the description of the transform coder stage 26 which is shown in block form in FIG. 1 and in a detailed block form in FIG. 3. The stage 46 operates to shift the determination of the pitch frequency from the stage 66 through a relatively small range above and below the determined pitch frequency to provide a optimal matching with such harmonic synthesis. In this way, the determination of the pitch frequency in each time frame is refined if there is still any ambiguity in this determination. As will be appreciated, a sequence of 512 successive frequencies can be represented in a binary sequence of nine (9) binary bits. Furthermore, the pitch frequency of male and female voices generally falls in this binary range of 512 discrete frequencies. As will be seen subsequently, the pitch frequency of the voice signals in each time frame 14 is indicated by nine (9) binary bits.

The signals from the stage 46 are introduced to a stage 48 for determining a harmonic difference. In the stage 48, the peak amplitudes of all of the odd harmonics are added to provide one cumulative value and the peak amplitudes of all of the even harmonics are added to provide another cumulative value. The two cumulative values are then compared. When the cumulative value for the even harmonics exceeds the cumulative value for the odd harmonics by a particular value such as approximately fifteen per cent (15%), the lowest one of the even harmonics is selected as the pitch frequency. Otherwise, the lowest one of the odd harmonics is selected.

Figure 8:
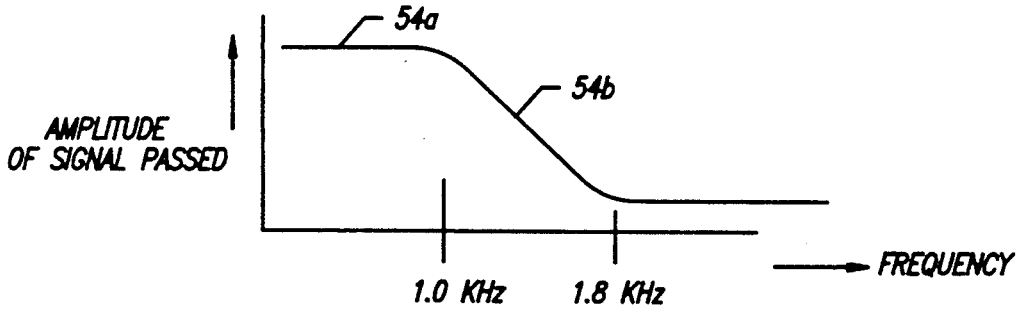
FIG. 8 illustrates the characteristics of a low pass filter for operating upon the frequency signals such as shown in FIG. 7.

The voice signals on the lines 32 (for the alternate time frames 14) and 36 (for the remaining time frames 14) are introduced to a low pass filter 52. The filter 52 has characteristics for passing the full amplitudes of the signal components in the pairs of successive time frames with frequencies less than approximately one thousand hertz (1000 Hz). This is illustrated at 54*a* in FIG. 8. As the frequency components increase above one thousand hertz (1000 Hz), progressive portions of these frequency components are filtered. This is illustrated at 54*b* in FIG. 8. As will be seen in FIG. 8, the filter has a flat response 54*a* to approximately one thousand hertz (1000 Hz) and the response then decreases relatively rapidly between a range of frequencies such as to approximately eighteen hundred hertz (1800 Hz). The lowpass filtered signal is subsampled by a factor of two—i.e., alternate samples are discarded. This is consistent with the theory since the frequencies above 2000 Hz have been nearly diminished.

Figure 9:
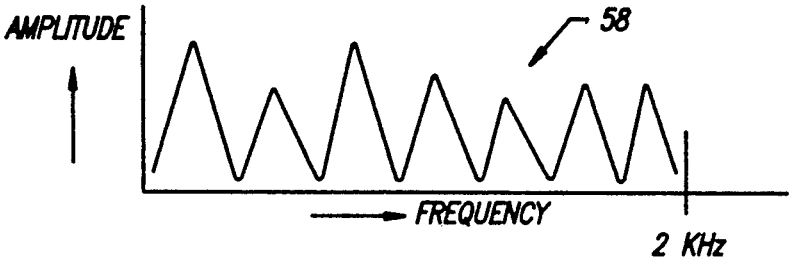
FIG. 9 is a diagram schematically illustrating a spectrum of frequency signals after the frequency signals of FIG. 7 have been passed through a low pass filter with the characteristics shown in FIG. 8.

The signals passing through the low pass filter 52 in FIG. 4 are introduced to a stage 56 for providing a frequency transform such as a Fourier frequency transform. By filtering increasing amplitudes of the signals with progressive increases in frequency above one thousand Hertz (1000 Hz), the frequency transformed signals generally indicated at 58 in FIG. 9 are spread out more in the frequency spectrum than the signals in FIG. 7. This may be seen by comparing the frequency spectrum of the signals produced in FIG. 9 as a result of the filtering in comparison with the frequency spectrum in FIG. 7. The spreading of the frequency spectrum in FIG. 9 causes the resolution in the signals to be enhanced. For example, the frequency resolution may be increased by a factor of two (2).

The signals from the low pass filter 52 are also introduced to a stage 60 for providing a Cepstrum computation or analysis. Stages providing Cepstrum computations or analyses are well known in the art. In such a stage, the highest peak amplitude of the filtered signals in each pair of successive time frames 14 is determined. This signal may be indicated at 62 in FIG. 6. The time between this signal 62 and a signal 64 with the next highest peak amplitude in the pair of successive time frames 14 may then be determined. This time is indicated at 66 in FIG. 6. The time 66 is then translated into a pitch frequency for the signals in the pair of successive time frames 14.

The determination of the pitch frequency in the stage 60 is introduced to a stage 66 in FIG. 4. The stage 66 receives the signals from a stage 68 which performs logarithmic calculations on the amplitudes of the frequency signals from the stage 56 in a manner similar to that described above for the stage 38. The stage 66 provides harmonic gap calculations of the pitch frequency in a manner similar to that described above for the stage 40. The stage 66 accordingly modifies (or provides a refinement in) the determination of the frequency from the stage 60 if there is any ambiguity in such determination. Alternatively, the stage 60 may be considered to modify (or provide a refinement in) the signals from the stage 66. As will be appreciated, there may be an ambiguity in the determination of the pitch frequency from the stage 60 if the time determination should be made from a different peak amplitude than the highest peak amplitude in the two (2) successive time frames or if the time between the successive peaks does not provide a precise indication of the pitch frequency.

As previously described, the stage 34 provides a frequency transform such as a Fourier frequency transform on the signals in the line 36 which receives the voice signals in the second of the two (2) successive time frames 14 in each pair. The frequency signals from the stage 34 pass to a stage 70 which provides a log magnitude computation or analysis corresponding to the log magnitude computations or analyses provided by the stages 38 and 68. The signals from the stage 70 in turn pass to the stage 66 to provide a further refinement in the determination of the pitch frequency for the voice signals in each pair of two (2) successive time frames 14.

The signals from the stage 66 pass to a stage 74 which provides a pitch match with a restored harmonic synthesis. This restored harmonic synthesis will be described in detail subsequently in connection with the description of the transform coder stage 26 which is shown in block form in FIG. 1 and in a detailed block form in FIG. 3. The pitch match performed by the stage 74 corresponds to the pitch match performed by the stage 46. The stage 74 operates to shift the determination of the pitch frequency from the stage 66 through a relatively small range above and below this determined pitch frequency to provide an optimal matching with such harmonic synthesis. In this way, the determination of the pitch frequency in each time frame is refined if there is still any ambiguity in this determination.

A stage 78 receives the refined determination of the pitch frequency from the stage 74. The stage 78 provides a further refinement in the determination of the pitch frequency in each time frame if there is still any ambiguity in such determination. The stage 78 operates to accumulate the sum of the amplitudes of all of the odd harmonics in the frequency transform signals obtained by the stage 74 and to accumulate the sum of the amplitudes of all of the even harmonics in such frequency transform. If the accumulated sum of all of the even harmonics exceeds the accumulated sum of all of the odd harmonics by a particular magnitude such as fifteen percent (15%) of the accumulated sum of the odd harmonics, the lowest frequency in the even harmonics is chosen as the pitch frequency. If the accumulated sum of the even harmonics does not exceed the accumulated sum of the odd harmonics by this threshold, the lowest frequency in the odd harmonics is selected as the pitch frequency. The operation of the harmonic difference stage 78 corresponds to the operation of the harmonic difference stage 48.

The signals from the stage 78 pass to a pitch interpolation stage 80. The pitch interpolation stage 80 also receives through a line 82 signals which represent the signals obtained from the stage 78 for one (1) previous frame. For example, if the signals passing to the stage 80 from the stage 78 represent the pitch frequency determined in time frames 1 and 2, the signals on the line 82 represent the pitch frequency determined for the frame 0. The stage 80 interpolates between the pitch frequency determined for the time frame 0 and the time frames 1 and 2 and produces information representing the pitch frequency for the time frame 1. This information is introduced to the stage 40 to refine the determination of the pitch frequency in that stage for the time frame 1.

The pitch interpolation stage 80 also employs heuristic techniques to refine the determination of pitch frequency for the time frame 1. For example, the stage 80 may determine the magnitude of the power in the frequency signals for low frequencies in the time frames 1 and 2 and the time frame 0. The stage 80 may also determine the ratio of the cumulative magnitude of the power in the frequency signals at low frequencies (or the cumulative magnitude of the amplitudes of such signals) in such time frames relative to the cumulative magnitude of the power (or the cumulative magnitude of the amplitudes) of the high frequency signals in such time frames. These factors, as well as other factors, may be used in the stage 80 in refining the pitch frequency for the time frame 1.

The output from the pitch interpolation stage 80 is introduced to the harmonic gap computation stage 40 to refine the determination of the pitch frequency in the stage 38. As previously described, this determination is further refined by the pitch match stage 46 and the harmonic difference stage 48. The output from the harmonic difference stage 48 indicates in nine (9) binary bits the refined determination of the pitch frequency for the time frame 1. These are the first binary bits that are transmitted to the voice decoder shown in FIG. 2 to indicate to the voice decoder the parameters identifying the characteristics of the voice signals in the time frame 1. In like manner, the harmonic difference stage 78 indicates in nine (9) binary bits the refined estimate of the pitch frequency for the time frame 2. These are the first binary bits that are transmitted to the voice decoder shown in FIG. 2 to indicate the parameters of the voice signals in the time frame 2. As will be appreciated, the system shown in FIG. 4 and described above operates in a similar manner to determine and code the pitch frequency in successive pairs of time frames such as time frames 3 and 4, 5 and 6, etc.

The transform coder 26 in FIG. 1 is shown in detail in FIG. 3. The transform coder 26 includes a stage 86 for determining the amplitude and phase of the signals at the fundamental (or pitch) frequency and the amplitude and phase of each of the harmonic signals. This determination is provided in a range of frequencies to approximately four KiloHertz (4 KHz) bandwidth. The determination is limited to approximately four thousand hertz (4 KHz) because the limit of four thousand hertz (4 Kz) corresponds to the limit of frequencies encountered in the telephone network as a result of adapted standards.

As first step in determining the amplitude and a phase of the pitch frequency and the harmonics in each time frame 14, the stage 86 divides the frequency range to four thousand Hertz (4000 Hz) into a number of frequency blocks such as thirty two (32). The stage 86 then divides each frequency block into a particular number of grids such as approximately sixteen (16). Several frequency blocks 96 and the grids 98 for one of the frequency blocks are shown in FIG. 12. The stage 86 knows, from the determination of the pitch frequency in each time frame 14, the frequency block in which each harmonic frequency is located. The stage 86 then determines the particular one of the sixteen (16) grids in which each harmonic is located in its respective frequency block. By precisely determining the frequency of each harmonic signal, the amplitude and phase of each harmonic signal can be determined with some precision, as will be described in detail subsequently.

As a first step in determining with some precision the frequency of each harmonic signal in the Fourier frequency transform produced in each time frame 14, the stage 86 provides a Hamming window analysis of the voice signals in such time frame 14. A Hamming window analysis is well known in the art. In a Hamming window analysis, the voice signals 92 (FIG. 10) in each time frame 14 are modified as by a curve having a dome-shaped pattern 94 in FIG. 10. As will be seen, the dome-shaped pattern 94 has a higher amplitude with progressive positions toward the center of the time frame 14 then toward the edges of the time frame. This relative de-emphasis of the voice signals at the opposite edges of each time frame 14 is one reason why the time frames are overlapped as shown in FIG. 6.

When the Hamming pattern 94 is used to modify the voice signals in each time frame 14 and a Fourier transform is made of the resultant pattern for an individual frequency, a frequency pattern such as shown in FIG. 11 is produced. This frequency pattern may be produced for one of the sixteen (16) grids in the frequency block in which a harmonic is determined to exist. Similar frequency patterns are determined for the other fifteen (15) grids in the frequency block. The grid which is nearest to the location of a given harmonic is selected.

By determining the particular one of the sixteen (16) grids in which the harmonic is located, the frequency of the harmonic is selected with greater precision than in the prior art.

In this way, the amplitude and phase are determined for each harmonic in each time frame 14. The phase of each harmonic is encoded for each time frame 14 by comparing the harmonic frequency in each time frame 14 with the harmonic frequency in the adjacent time frames. As will be be appreciated, changes in the phase of a harmonic signal result from changes in frequency of that harmonic signal. Since the period in each time frame 1 is relatively short and since there is a time overlap between adjacent time frames, any changes in pitch frequency in successive time frames may be considered to result in changes in phase.

As a result of the analysis as discussed above, pairs of signals are generated for each harmonic frequency, one of these signals representing amplitude and the other representing phase. These signals may be represented as $a_1\phi_1$, $a_2\phi_2$, $a_3\phi_3$, etc.

In this sequence $a_1$, $a_2$, $a_3$, etc. represent the amplitudes of the signals at the fundamental frequency and the second, third, etc. harmonics of the pitch frequency signals in each time frame; and $\phi_1$, $\phi_2$, $\phi_3$, etc. represent the phases of the signals at the fundamental frequency and the second, third, etc. harmonics in each time frame 14.

Although the amplitude values $a_1$, $a_2$, $a_3$, etc., and the phase values $\phi_1$, $\phi_2$, $\phi_3$, etc. may represent the parameters of the signals at the fundamental pitch frequency and the different harmonics in each time frame 14 with some precision, these values are not in a form which can be transmitted from the voice coder 18 shown in FIG. 1 to a voice decoder generally indicated at 100 in FIG. 2. The circuitry shown in FIG. 3 provides a conversion of the amplitude values $a_1$, $a_2$, $a_3$, etc., and the phase values $\phi_1$, $\phi_2$, $\phi_3$, etc. to a meaningful binary form for transmission to the voice decoder 100 in FIG. 2 and for decoding at the voice decoder.

To provide such a conversion, the signals from the harmonic analysis stage 86 in FIG. 3 are introduced to a stage 104 designated as "spectrum shape calculation". The stage 104 also receives the signals from a stage 102 which is designated as "get band amplitude". The input to the stage 102 corresponds to the input to the stage 86. The stage 102 determines the frequency band in which the amplitude of the signals occurs.

As a first step in converting the amplitudes $a_1$, $a_2$, $a_3$, etc., to meaningful and simplified binary values for transmission to the voice decoder 100, the logarithms of the amplitude values $a_1$, $a_2$, $a_3$, etc., are determined in the stage 104 in FIG. 3. Taking the logarithm of these amplitude values is desirable because the resultant values become compressed relative to one another without losing their significance with respect to one another. The logarithms can be with respect to any suitable base value such as a base value of two (2) or a base value of ten (10).

The logarithmic values of amplitude are then compared in the stage 104 in FIG. 3 to select the peak value of all of these amplitudes. This is indicated schematically in FIG. 13 where the different frequency signals and the amplitudes of these signals are indicated schematically and the peak amplitude of the signal with the largest amplitude is indicated at 106. The amplitudes of all of the other frequency signals are then scaled with the peak amplitude 106 as a base. In other words, the difference between the peak amplitude 106 and the magnitude of each of the remaining amplitude values $a_1$, $a_2$, $a_3$, etc., is determined. These difference values are indicated schematically at 108 in FIG. 14.

The difference values 108 in FIG. 14 are next companded. A companding operation is well known in the art. In a companding operation, the difference values shown in FIG. 14 are progressively compressed for values at the high end of the amplitude range. This is indicated schematically at 110 in FIG. 15. In effect, the amplitude values closest to the peak values in FIG. 13 are emphasized by the companding operation relative to the amplitudes of low value in FIG. 13.

As the next step in converting the amplitude values $a_1$, $a_2$, $a_3$, etc., to a meaningful and simplified binary form, the number of such values is limited in the stage 104 to a particular value such as forty five (45) if the amplitude values exceed forty five (45). This limit is imposed by disregarding the harmonics having the highest frequency values. Disregarding the harmonics of the highest frequency does not result in any deterioration in the faithful reproduction of sound since most of the information relating to the sound is contained in the low frequencies.

As a next step, the number of harmonics is limited in the stage 104 to a suitable number such as sixteen (16) if the number of harmonics is between sixteen (16) and twenty (20). This is accomplished by eliminating alternate ones of the harmonics at the high end of the frequency range if the number of harmonics is between sixteen (16) and twenty (20). If the number of harmonics is less than sixteen (16), the harmonics are expanded to sixteen (16) by pairing successive harmonics at the upper frequency end to form additional harmonics between the paired harmonics and by interpolating the amplitudes of the additional harmonics in accordance with the amplitudes of the paired harmonics.

In like manner, if the number of harmonics is greater than twenty four (24), alternate ones of the harmonics are eliminated at the high end of the frequency range until the number of harmonics is reduced to twenty four (24). If the number of harmonics is between twenty one (21) and twenty four (24), the number of harmonics is increased to twenty four (24) by pairing successive harmonics at the upper frequency end to form additional harmonics between the paired harmonics and by interpolating the amplitudes of the additional harmonics in accordance with the amplitudes of the paired harmonics.

After the number of harmonics has been limited to sixteen (16) or twenty four (24) depending upon the number of harmonics produced in the Fourier frequency transform, a discrete cosine transform is provided in the stage 104 on the limited number of harmonics. The discrete cosine transform is well known to be advantageous for compression of correlated signals such as in a spectrum shape. The discrete cosine transform is taken over the full range of sixteen (16) or twenty four (24) harmonics. This is different from the prior art because the prior art obtains several discrete cosine transforms of the harmonics, each limited to approximately eight (8) harmonics. However, the prior art does not limit the total number of frequencies in the transform such as is provided in the system of this invention when the number is limited to sixteen (16) or twenty four (24).

The results obtained from the discrete cosine transform discussed in the previous paragraph are subsequently converted by a stage 110 to a particular number of binary bits to represent such results. For example, the results may be converted to forty eight (48), sixty four (64) or eighty (80) binary bits. The number of binary bits is preselected so that the voice decoder 100 will know how to decode such binary bits. In coding the results of the discrete cosine transform, a greater emphasis is preferably placed on the low frequency components of the discrete cosine transform relative to the high frequency components. For example, the number of binary bits used to indicate the successive values from the discrete cosine transform may illustratively be a sequence 5, 5, 4, 4, 3, 3, 3 . . . 2, 2 . . . , , 0, 0, 0. In this sequence, each successive number from the left represents a component of progressively increasing frequency. The 48, 64 or 80 binary bits representing the results of the discrete cosine transform are transmitted to the voice decoder 100 in FIG. 2 after the transmission of the nine (9) binary bits representing the pitch or fundamental frequency.

A stage 112 in FIG. 3 receives the signals representing the discrete cosine transform from the stage 104 and reconstructs these signals to a form corresponding to the Fourier frequency transform signals introduced to the stage 86. As a first step in this reconstruction, the stage 112 receives the signals from the stage 104 and provides an inverse of a discrete cosine transform. The stage 112 then expands the number of harmonics to coincide with the number of harmonics in the Fourier frequency transform signals introduced to the stage 86. The stage 112 does this by interpolating between the amplitudes of successive pairs of harmonics in the upper end of the frequency range. The stage 112 then performs a decompanding operation which is the inverse of the companding operation performed by the stage 110. The signals are now in a form corresponding to that shown in FIG. 14.

To convert the signals to the form shown in FIG. 13, a difference is determined between the peak amplitude 106 shown in FIG. 13 for each harmonic and the amplitude shown in FIG. 14 for such harmonic. The resultant amplitudes correspond to those shown in FIG. 13, assuming that each step in the reconversion provided in the stage 112 provides ideal calculations. The signals corresponding to those shown in FIG. 13 are then processed in the stage 112 to remove the logarithmic values and to obtain Fourier frequency transform signals corresponding to those introduced to the stage 86.

The reconstructed Fourier frequency transform signals from the stage 112 are introduced to a stage 116. The Fourier frequency transform signals passing to the stage 86 are also introduced to the stage 116 for comparison with the reconstructed Fourier frequency transform signals in the stage 112. To provide this comparison, the Fourier frequency transform signals from each of the stages 86 and 112 are considered to be disposed in twelve (12) frequency slots or bins 118 as shown in FIG. 16. Each of the frequency slots or bins 118 has a different range of frequencies than the other frequency slots or bins. The number of frequency slots or bins is arbitrary but twelve (12) may be preferable. It will be appreciated that more than one (1) harmonic may be located in each time slot or bin 118.

The stage 116 compares the amplitudes of the Fourier frequency transform signals from the stage 112 in each frequency slot or bin 118 and the signals introduced to the stage 86 for that frequency slot or bin. If the amplitude match is within a particular factor for an individual one of the time slot or bin 118, the stage 116 produces a binary "1" for that time slot or bin. If the amplitude match is not within the particular factor for an individual time slot or bin 118, the stage 116 produces a binary "0" for that time slot or bin. The particular factor may depend upon the pitch frequency and upon other quality factors.

FIG. 16 illustrates when a binary "1" is produced in a time slot or bin 118 and when a binary "0" is produced in a time slot or bin 118. As will be seen, when the correlation between the signals in the stages 86 and 112 is high as indicated by a signal of large amplitude, a binary "1" is produced in a time slot or bin 118. However, when the correlation is low as indicated by a signal of low amplitude, a binary "0" is produced for a time slot or bin 118. In effect, the stage 116 provides a binary "1" only in the frequency slots or bins 118 where the stage 104 has been successful in converting the frequency indications in the stage 86 to a form closely representing the indications in the stage 86. In the time slots or bins 118 where such conversion has not been successful, the stage 116 provides a binary "0".

Some post processing may be provided in the stage 116 to reconsider whether the binary value for a time slot or bin 118 is a binary "1" or a binary "0". For example, if the binary values for successive time slots or bins is "000100", the binary value of "1" in this sequence in the time frame 114 under consideration may be reconsidered in the stage 116 on the basis of heuristics. Under such circumstances, the binary value for this time slot or bin in the adjacent time frames 14 could also be analyzed to reconsider whether the binary value for this time slot or bin in the time frame 14 under consideration should actually be a binary "0" rather than a binary "1". Similar heuristic techniques may also be employed in the stage 116 to reconsider whether the binary value of "0" in the sequence of 11101 should be a binary "1" rather than a binary "0".

The twelve (12) binary bits representing a binary "1" or a binary "0" in each of the twelve (12) time slots or bins (118) in each time frame 14 are introduced to the stage 110 in FIG. 3 for transmission to the voice decoder 100 shown in FIG. 1. These twelve (12) binary bits in each time frame may be produced immediately after the nine (9) binary bits representing the pitch frequency and may be followed by the 48, 64 or 80 binary bits representing the amplitudes of the different harmonics. A binary "1" in any of these twelve (12) time bins or slots 118 may be considered to represent voiced signals for such time bin or slot. A binary "0" in any of these twelve (12) time bins or slots 118 may be considered to represent unvoiced signals for such time bin or slot. For a time bin or slot where unvoiced signals are produced, the amplitude of the harmonic or harmonics in such time bin or slot may be considered to represent noise at an average of the amplitude levels of the harmonic or harmonics in such time slot or bin.

The binary value representing the voiced (binary "1") or unvoiced (binary "0") signals from the stage 116 are introduced to the stage 104. For the time slots or bins 118 where a binary "1" has been produced by the stage 116, the stage 104 produces binary signals representing the amplitudes of the signals in the time slots or bins. These signals are encoded by the stage 110 and are transmitted through a line 124 to the voice decoder shown in FIG. 2. When a binary "0" is produced by the stage 116 for a time slot or bin 118, the stage 104 produces "noise" signals having an amplitude representing the average amplitude of the signals in the time slot or bin. These signals are encoded by the stage 110 into binary form and are transmitted through the line 124 to the voice decoder.

The phase signals $\phi_1$, $\phi_2$, $\phi_3$, etc. for the successive harmonics in each time frame 14 are converted in a stage 120 in FIG. 3 to a form for transmission to the voice decoder 100. If the phase of the signals for a harmonic has at least a particular continuity in a particular time frame 14 with the phase of the signals for the harmonic in the previous time frame, the phase of the signal for the harmonic in the particular time frame is predicted from the phase of the signal for the harmonic in the previous time frame. The difference between the actual phase and this prediction is what is transmitted for the phase of the signal for the harmonic in the particular time frame. For a particular number of binary bits to represent such harmonic, this difference prediction can be transmitted with more accuracy to the voice decoder 100 than the information representing the phase of the signal constituting such harmonic in such particular time frame. However, if the phase of the signal for such harmonic in such particular time frame 14 does not have at least the particular continuity with the phase of the signal for such harmonic in the previous time frame, the phase of the signal for such harmonic in such particular time frame is transmitted to the voice decoder 100.

As with the amplitude information, a particular number of binary bits is provided to represent the phase, or the difference prediction of the phase, for each harmonic in each time frame. The number of binary bits representing the phases, or the difference predictions of the phases, of the harmonic signals in each time frame 14 is computed as the total bits available for the time frame minus the bits already used for prior information. The phases, or the difference predictions of the phases, of the signals at the lower harmonic frequencies are indicated in a larger number of binary bits than the phases of the signals, or the difference predictions of the phases, of the signals at the higher frequencies.

The binary bits representing the phases, or the predictions of the phases, for the signals of the different harmonics in each time frame 14 are produced in a stage 130 in FIG. 3, this stage being designated as "phase encoding". The binary bits representing the phases, or the prediction of the phases, of the signals at the different harmonics in each time frame 14 are transmitted through a line 132 in each time frame 14 after the binary bits representing the amplitudes of the signals at the different harmonics in each time frame.

The voice decoder 100 is shown in a simplified block form in FIG. 2. The voice decoder 100 includes a line 140 which receives the coded voice signals from the voice coder 18. A transform decoder stage generally indicated at 142 operates upon these signals, which indicate the pitch frequency and the amplitudes and phases of the pitch frequency and the harmonics, to recover the signals representing the pitch frequency and the harmonics. A stage 144 performs an inverse of a Fourier frequency transform on the recovered signals representing the pitch frequency and the harmonics to restore the signals to a time domain form. These signals are further processed in the stage 144 by compensating for the effects of the Hamming window 94 shown in FIG. 10. In effect, the stage 144 divides by the Hamming window 94 to compensate for the multiplication by the Hamming window in the voice coder 18. The signals in the time domain form are then separated in a stage 146 into the voice signals in the successive time frames 14 by taking account of the time overlap still remaining in the signals from the stage 144. This time overlap is indicated at 1 in FIG. 6.

Figure 5:
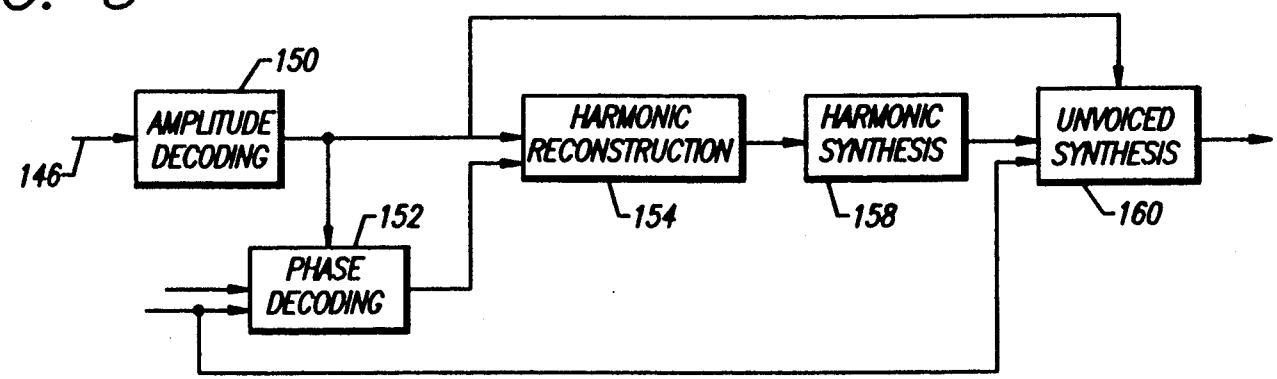
FIG. 5 is a block diagram of the voice decoder shown in FIG. 2 and shows the decoding system in more detail than that shown in FIG. 2.

The transform decoder stage 142 is shown in block form in additional detail in FIG. 5. The transform decoder 142 includes a stage 150 for receiving the 48, 64 or 80 bits representing the amplitudes of the pitch frequency and the harmonics and for decoding these signals to determine the amplitudes of the pitch frequency and the harmonics. In decoding such signals, the stage 150 performs a sequence of steps which are in reverse order to the steps performed during the encoding operation and which are the inverse of such steps. As a first step in such decoding, the stage 150 performs the inverse of a discrete cosine transform on such signals to obtain the frequency components of the voice signals in each time frame 14.

As will be appreciated, the number of signals produced as a result of the inverse discrete cosine transform depends upon the number of the harmonics in the voice signals at the voice coder 18 in FIG. 1. The number of harmonics is then expanded or compressed to the number of harmonics at the voice coder 18 by interpolating between successive pairs of harmonics at the upper end of the frequency range. The number of harmonics in the voice signals at the voice coder 18 in each time frame can be determined in the stage 18 from the pitch frequency of the voice signals in that time frame. As will be appreciated, if an expansion in the number of harmonics occurs, the amplitude of each of these interpolated signals may be determined by averaging the amplitudes of the harmonic signals with frequencies immediately above and below the frequency of this interpolated signal.

A decompanding operation is then performed on the expanded number of harmonic signals. This decompanding operation is the inverse of the companding operation performed in the transform coder stage 26 shown in FIG. 1 and in detail in FIG. 3 and shown schematically in FIG. 15. The decompanded signals are then restored to a base of zero (0) as a reference from the peak amplitude of all of the harmonic signals as a reference. This corresponds to a conversion of the signals from the form shown in FIG. 14 to the form shown in FIG. 13.

A phase decoding stage 152 (FIG. 3) in FIG. 5 receives the signals from the amplitude decoding stage 150. The phase decoding stage 152 determines the phases $\phi_1$, $\phi_2$, $\phi_3$, etc. for the successive harmonics in each time frame 14. The phase decoding stage 152 does this by decoding the binary bits indicating the phase of each harmonic in each time frame 14 or by decoding the binary bits indicating the difference predictions of the phase for such harmonic in such time frame 14. When the phase decoding stage 152 decodes the difference prediction of the phase of a harmonic in a particular time frame 14, it does so by determining the phase for such harmonic in the previous time frame 14 and by modifying such phase in the particular time frame 14 in accordance with such phase prediction for such time frame.

The decoded phase signals from the phase decoding stage 152 ar introduced to a harmonic reconstruction stage 154 as are the signals from the amplitude decoding stage 150. The harmonic reconstruction stage 154 operates on the amplitude signals from the amplitude decoding stage 150 and the phase signals from the phase decoding stage 154 for each time frame 14 to reconstruct the harmonic signals in such time frame. The harmonic reconstruction stage 152 reconstructs the harmonics in each time frame 152 by providing the frequency pattern (FIG. 11) at different frequencies to determine the pattern at such different frequencies of the signals introduced to the stage 154.

The signals from the harmonic reconstruction stage 154 are introduced to a harmonic synthesis stage 158. The stage 158 operates to synthesize the Fourier frequency coefficients by positioning the harmonics and multiplying these harmonics by the Fourier frequency transform of the Hamming window 94 shown in FIG. 10. The signals from the harmonic synthesis stage 158 pass to a stage 160 where the unvoiced signals (binary "0") in the time slots or bins 118 (FIG. 16) are provided on a line 167 and are processed. In these frequency bins or slots 118, signals having a noise level represented by the average amplitude level of the harmonic signals in such time slots or bins are provided on the line 168. These signals are processed in the stage 160 to recover the frequency components in such time slots. As previously indicated, the signals from the stage 160 are subjected in the stage 144 in FIG. 2 to the inverse of the Fourier frequency transform. The resultant signals are in the time domain and are modified by the inverse of the Hamming window 94 shown in FIG. 10. The signals from the stage 144 accordingly represent the voice signals in the successive time frames 14. The overlap in the successive time frames 14 is removed in the stage 146 to reproduce the voice signals in a continuous pattern.

The apparatus and methods described above have certain important advantages. They employ a plurality of different techniques to determine, and then refine the determination of, the pitch frequency in each of a sequence of overlapping time frames. They employ refined techniques to determine the amplitude and phase of the pitch frequency signals and the harmonic signals in the voice signals of each time frame. They also employ refined techniques to convert the amplitude and phase of the pitch frequency signals and the harmonic signals to a binary form which accurately represents the amplitudes and phases of such signals.

The apparatus and methods described in the previous paragraph are employed at the voice coder. The voice decoder employs refined techniques which are the inverse of those, and are in reverse order to those, at the voice coder to reproduce the voice signals. The apparatus and methods employed at the voice decoder are refined in order to process, in reverse order and on an inverted basis, the encoded signals to recover the voice signals introduced to the voice encoder.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

I claim:

1. In combination for use in a voice coder to determine the pitch frequency of voice signals introduced to the voice coder, first means for dividing the voice signals into successive time frames, second means for providing a frequency transform of the voice signals in each time frame to obtain a plurality of signals at different frequencies in such time frame, the signals at the different frequencies in each time frame having a pitch frequency, third means for providing a Cepstrum determination of the signals from the Fourier frequency transform in each of the successive time frames to obtain a determination of the pitch frequency of the frequency signals in such time frame, and fourth means for providing a harmonic gap determination of the frequency signals in each of the successive time frames from the Cepstrum determination to refine the determination of the pitch frequency by the third means of the frequency signals in each time frame.

2. In a combination as set forth in claim 1, the frequency signals in each time frame constituting harmonics and having amplitudes, fifth means responsive to the detections provided by the third and fourth means of the pitch frequency of the frequency signals in each time frame for determining the relative cumulative amplitudes of the signals constituting the odd harmonics in the frequency transform and the signals constituting the even harmonics in the frequency transform to refine the determination of the pitch frequency by the third and fourth means of the pitch frequency of the frequency signals in each time frame.

3. In a combination as set forth in claim 2 wherein the frequency signals in each time frame have low frequencies and high frequencies and have energy at these different frequencies and the fifth means includes means for determining the energy in the frequency signals at low frequencies in the frequency transform in each of the successive time frames and the energy in the frequency signals at high frequencies in the frequency transform in each of the successive time frames and further includes means for determining the ratio of the energy of the frequency signals at the low frequencies in the frequency transform in each of the successive time frames to the energy in the frequency signals at the high frequencies in the frequency transform in each of the successive time frames.

4. In a combination as set forth in claim 3 wherein the amplitudes of the voice signals have peaks at the different frequencies and troughs between the peaks and the fourth means includes means for selecting in each successive time frame signals with the highest peaks in the amplitudes at the different frequencies and means for determining in each successive time frame the amplitude difference between these peaks in the amplitudes and the troughs between these peaks in the amplitudes and the peaks in the amplitudes of the adjacent harmonics to refine the determination of the pitch frequency by the third means in each time frame.

5. In a combination as set forth claim 4 wherein the frequency signals in each time frame have phases and wherein the third means determines the phases and amplitudes of the peaks in the amplitudes of the signals at the different frequencies in each successive time frame.

6. In a combination as set forth in claim 5 wherein the firth through fifth means are located at the voice coder and wherein the signals rom the fifth means in each time frame are transmitted to a voice decoder and wherein means are located at the voice decoder to receive and decode the transmitted signals in each time frame and obtain a recovery of the voice signals in each time frame.

7. In a combination as set forth in claim 4, wherein the second means providing the frequency transform in each time frame produce a frequency spectrum of the frequency signals in each time frames and wherein means are included at the voice coder for providing signals representing the amplitude of the signals in the frequency spectrum in each time frame and wherein means are provided at the voice coder for providing signals representing the phases of the signals in the frequency spectrum in each time frame and wherein the signals representing the pitch frequency and the signals representing the amplitudes and the phases of the signals in the frequency spectrum in each time frame are transmitted to a voice decoding station and wherein means are provided at the voice decoding station for receiving the transmitted signals in each time frame and for operating upon the transmitted signals to recover the voice signals introduced to the voice coder.

8. In combination for use in a voice coder on voice signals having a pitch frequency, first means for dividing the voice signals into successive time frames, second means for converting the voice signals in each time frame into signals in a frequency spectrum, the signals in the frequency spectrum in each time frame having a pitch frequency, third means responsive to the signals from the second means in each time frame for producing signals indicating the pitch frequency of the signals in the frequency spectrum in each time frame, and fourth means responsive to the signals in the frequency spectrum in each time frame for performing additional determinations of pitch frequency on the signals in the frequency spectrum in each successive pair of time frames to refine the determination f the pitch frequency in the signals in each time frame in such successive pair, and fifth means for interpolating the pitch frequency of the signals in the frequency spectrum in the time frames in each successive pair in accordance with the additional determinations by the fourth means of the pitch frequency of the signals in the frequency spectrum in the time frames in that pair.

9. In a combination as set forth in claim 8 wherein the third means performs harmonic gap analyses and pitch match analyses on the signals from the second means in the frequency spectrum in each time frame to obtain a determination of the pitch frequency of the signals in the frequency spectrum in such time frame.

10. In a combination as set forth in either of claims 8 or 9 wherein the fourth means performs a Cepstrum analysis on he signals in the frequency spectrum in each successive pair of time frames and performs a harmonic gap analysis of the signals in the frequency spectrum in each successive pair of time frames and interpolates the signals in the frequency spectrum in a particular one of the time frames in each successive pair prior to the harmonic gap analysis in that particular time frame in accordance with the harmonic gap analysis of the signals in such successive pair of time frames.

11. In a combination as set forth in claim 10, including the signals in the frequency spectrum in each time frame having an amplitude and a phase, means for determining the amplitude and phase of each of the signals in the frequency spectrum in each time frame, means for converting the signals from the means to binary signals for transmission, and means for converting the determined amplitude and phase of the harmonics in each time frame to binary signals for transmission.

12. In a combination as set forth in claim 11, a voice decoder, means for transmitting to the voice decoder the binary signals representing the pitch frequency and representing the amplitude and phase of the harmonics in the signals in the frequency spectrum in each time frame, and means at the voice decoder for operating upon the transmitted signals to receive the transmitted signals in each time frame and to recover from such transmitted signals the voice signals introduced to the voice coder in each time frame.

13. In combination or use in a voice coder to determine the pitch frequency of voice signals in the voice coder, first means for dividing the voice signals into successive time frames, second means for obtaining a frequency transform of the voice signals in each of the successive time frames to obtain frequency signals in such time frame, third means for obtaining a log spectrum of the signals in the frequency transform in each of the successive time frames, each of the signals in the frequency transform having a peak amplitude and defining a trough between such peak amplitude and the next peak amplitude, fourth means for determining the peak amplitudes of the signals in the frequency transform in each of the successive time frames and the troughs between the peak amplitudes of such signals, fifth means for determining the pitch frequency of the signals in the frequency transform in each time frame by a harmonic gap analysis of the peak amplitudes of the signals in the frequency transform in each time frame and the troughs between the peak amplitudes of the signals in the frequency transform in each time frame, and sixth means for refining the determination of the pitch frequency of the signals in the frequency transform in each time frame in accordance with the determination of the pitch frequency of the signals in the frequency transforms of previous time frames.

14. In a combination as set forth in claim 13 including the signals in the frequency transform in each time frame providing the pitch frequency and harmonics of the pitch frequency, seventh means for refining the determination of the pitch frequency of the signals in the frequency transform in each time frame by determining the cumulative peak amplitudes of the signals in the even harmonics in the signals in the frequency transform in each time frame and the cumulative peak amplitudes of the signals in the odd harmonics in the signals in the frequency transform in such time frame and by comparing the cumulative peak amplitudes of the signals in the even harmonics and in the odd harmonics in each time frame to select the lowest one of the odd harmonics or of the even harmonics in each time frame in accordance with such comparison.

15. In a combination as set forth in claim 14, each of the signals in the frequency transform in each time frame having an amplitude and having an energy based upon such amplitude, eighth means for refining the pitch frequency determined by the fifth, sixth and seventh means by determining the cumulative magnitude of the energy in the frequency signals with low harmonics in each time frame relative to the cumulative magnitude of the energy in the frequency signals with high harmonics in each time frame.

16. In a combination as set forth in claims 13 including seventh means for interpolating between the pitch frequency in the signals in the frequency transform in each time frame and the pitch frequency of the signals int he frequency transform in an immediately previous time frame and for refining the determinations by the fifth and sixth means of the pitch frequency of the signals in the frequency transform in each time frame in accordance with such interpolation.

17. In a combination as set forth in claim 16, the signals in the frequency transform in each time frame providing the pitch frequency and harmonics of the pitch frequency and having amplitudes and phases, a voice decoder, means for determining the amplitudes and phases of the the signals in the frequency transform in each time frame, means for transmitting to the voice decoder the signals representing the pitch frequency and the amplitudes and phases of the signals in the frequency transform in each time frame, and means at the voice decoder for receiving and operating upon the signals transmitted to the voice decoder in each time frame to recover the voice signals in the voice coder in each time frame.

18. In a combination as set forth in claim 13, the signals in the frequency transform in each time frame having amplitudes and phases, eighth means for determining the amplitudes and the phases of the signals in the frequency transform in each time frame, ninth means for reconstructing the frequency transform from the pitch frequency and the amplitudes and phases determined for the signals in the frequency transform in each time frame, and tenth means for comparing the signals provided by the second means and the reconstructed signals provided by the ninth means to provide a further refinement in the determination of the pitch frequency for the signals in the frequency transform in each time frame.

19. In a combination for use in a voice coder to determine the pitch frequency of voice signals in the voice coder, .

first means for dividing the voice signals into successive time frames, second means for obtaining a frequency transform of the voice signals in each of the successive time frames to obtain a spectrum of frequency signals in such time frame, each of the frequency signals in each time frame having a peak amplitude and troughs between successive pairs of such peak amplitudes, third means for obtaining a log spectrum of the frequency signals in each time frame, and fourth means for determining the frequency locations of the peak amplitudes and the troughs between the peak amplitudes in the spectrum of frequency signals from the third means in each time frame to determine the pitch frequency of such frequency signals in such time frame in accordance with the relative differences between such peaks and troughs.

20. In a combination as set forth in claim 19 where the fourth means is operative to determine the peak amplitudes of the frequency signals in each frequency transform in each time frame at the frequencies of a particular number of the peak amplitudes in the frequency spectrum in such time frame and at the frequencies around such frequencies of such peak amplitudes and to determine the amplitudes of the signals in the frequency transforms at the frequencies of the amplitude troughs following such peak amplitudes in the frequency spectrum in each time frame and at the frequencies around such frequencies of such troughs in each time frame.

21. In a combination as set forth in claim 20, the frequencies of the signals in the frequency spectrum in each time frame constituting the pitch frequency and harmonics of the pitch frequency, fifth means for refining the determination of the pitch frequency of the signals in the frequency spectrum in each time frame by determining the cumulative amplitudes of all of the even harmonics in the signals in the frequency spectrum in each time frame and the cumulative amplitudes of all of the odd harmonics in the signals in the frequency spectrum in such time frame and by choosing the pitch frequency in accordance with the relative magnitudes of the cumulative values of such odd harmonics and even harmonics in each time frame.

22. In a combination as set forth in claim 21 wherein sixth means includes means for determining in each time frame the pitch frequency of the signals in the frequency spectrum in the immediately preceding time frame and for refining the determination of the pitch frequency of the signals in the frequency spectrum in each time frame in accordance with the determination of the pitch frequency of the signals in the frequency spectrum in a time frame immediately preceding time frame.

23. In a combination as set forth in claim 22 wherein each of the signals in the frequency spectrum in each time frame has an energy dependent upon the amplitude of such signal and wherein seventh means are provided for determining the energy of the signals at low frequencies in the frequency spectrum in each time frame relative to the energy of the signals at high frequencies in the frequency spectrum in such time frame and for refining the determination of the pitch frequency in each time frame in accordance with such energy determinations.

24. In a combination as set forth in claim 22 wherein the sixth means includes means for determining in each time frame the pitch frequency of the signals in the frequency spectrum in the time frame immediately preceding such time frame and for determining a reliability of the determination of the pitch frequency in the immediately preceding time frame and for refining the determination of the pitch frequency of the signals in the frequency spectrum in each time frame in accordance with the determination of such reliability of the pitch frequency in the immediately preceding time frame.

25. In a combination as set forth in claim 21 wherein each of the signals in the frequency spectrum in each time frame has an energy with a magnitude dependent upon the peak amplitude of such signals and wherein the sixth means includes means for determining the cumulative magnitude of the energy of the signals at low frequencies in the frequency spectrum in each time frame and for determining the cumulative magnitudes of the energy at high frequencies in the frequency spectrum of the signals in each time frame and for determining the cumulative magnitudes of the energy of the signals at low frequencies in each time frame relative to the the cumulative magnitude of the energy of the signals at the high frequencies in such time frame and for refining the determination of the pitch frequency of the signals in the frequency spectrum in each time frame in accordance with the determination of such relative cumulative magnitudes of the energies at the low frequencies and the high frequencies in such time frame.

26. In a combination as set forth in claim 25 wherein each of the signals in the frequency spectrum in each time frame has a phase and wherein a voice decoder is included and wherein the signals representing the pitch frequency of the signals in the frequency spectrum in each time frame are transmitted from the voice coder to the voice decoder and wherein signals representing the peak amplitudes and the phases of the signals in the frequency spectrum in each time frame are transmitted from the voice coder to the voice decoder and wherein means are provided at the voice decoder for receiving and operating upon the transmitted signals in each time frame to obtain a recovery of the voice signals in the voice coder.

27. In combination for use on voice signals in a voice coder, first means for dividing the voice signals into successive time frames, second means for combining the voice signals in successive pairs of time frames to obtain an enhanced resolution of the voice signals in each time frame, third means for obtaining a frequency transform of the voice signals into signals in a frequency spectrum in each of the time frames in each successive pair, the signals in the frequency spectrum in each time frame having a pitch frequency, fourth means for passing the frequency signals in each of the successive pairs of time frames in a first particular range of frequencies and for providing a progressive filtering of the frequency signals in each of the successive pairs of time frames for progressive frequency values above the first particular range, and fifth means for obtaining a frequency transform in each successive pair of the time frames of the signals passed by the fourth means to obtain signals in a frequency spectrum each successive pair of time frames, and sixth means for operating upon the signals from the third means and the fifth means in a particular relationship for determining the pitch frequency of the signals in the frequency spectrum in each time frame.

28. In a combination as set forth in claim 27, wherein the sixth means include seventh means for interpolating the signals in the frequency spectrum from the fifth means for each successive pair of time frames and the signals in he frequency spectrum from the second means for one of the time frames in each successive pair, and the sixth means further include eighth means for interpolating the signals in the frequency spectrum from the second means for the other one of the time frames in each successive pair and the signals from the fifth means in the frequency spectrum for each successive pair of time frames and the signals from the second means in the frequency spectrum for one of the time frames in an immediately preceding pair.

29. In a combination as set forth in claim 28, each of the signals in the frequency spectrum in each time frame having an amplitude and a phase, means for determining the amplitudes of the signals in the frequency spectrum in each time frame, means for determining the phases of the signals in the frequency spectrum in each time frame, and means for transmitting a sequence of signals representing the pitch frequency, the amplitudes and the phases of the signals in the frequency spectrum in each time frame.

30. In a combination as set forth in claim 29, a voice decoder, and means at the voice decoder for receiving and processing the transmitted signals to obtain a recovery of the voice signals in each time frame.

31. In a combination as set forth in claim 30, means at the voice coder for providing a harmonic gap analysis and a harmonic difference analysis of the frequency signals in each time frame to obtain a determination of the pitch frequency of the signals in the frequency spectrum in that time frame, and means at the voice coder for providing a pitch match of the frequency signals in each time frame to obtain a refined determination of the pitch frequency of the signals in the frequency spectrum in such time frame.

32. In a combination for use in a voice coder to determine the pitch frequency of voice signals introduced to the voice coder, first means for dividing the voice signals into successive time frames, second means for providing a frequency transform of the voice signals in each successive time frame to produce signals in a frequency spectrum in that time frame, each of the signals having an amplitude and the signals constituting harmonics of a pitch frequency, third means for adding the amplitudes of the odd harmonics in the signals in the frequency spectrum in each time frame, fourth means for adding the amplitudes of the even harmonics in the signals in the frequency transform in each time frame, fifth means for normally selecting the odd harmonic in the frequency transform in each time frame with the lowest frequency as the pitch frequency, and sixth means for substituting the even harmonic in the frequency transform with the lowest frequency in each time frame as the pitch frequency when the sum of the amplitudes of the even harmonics in the frequency spectrum in such time frame exceeds the sum of the amplitudes of the odd harmonics in the frequency spectrum in such time frame by a particular threshold.

33. In a combination as set forth in claim 32, seventh means for providing a frequency transform of the voice signals in each successive pair of time frames to produce signals in a frequency spectrum in such successive pair of time frames, the signals having a pitch frequency, eighth means for determining the pitch frequency for the signals from the seventh means in each successive pair of time frames in accordance with a Cepstrum analysis, and ninth means responsive to the determination in each time frame of the pitch frequency of the signals in the frequency spectrum in each time frame by the sixth means and the determination of the pitch frequency of the signals in the frequency spectrum by the eighth means in each successive pair of time frames for interpolating the pitch frequency in one of the time frames of such successive pair in accordance with the pitch frequency determination of the signals in the frequency spectrum by the eighth means by the Cepstrum analysis in such successive pair of time frames.

34. In a combination as set forth in claim 32, seventh means for determining the pitch frequency of the signals in the frequency spectrum in each time frame in accordance with a harmonic gap analysis, and eighth means responsive to the harmonic gap analysis of the pitch frequency of the signals in the frequency spectrum in each time frame for refining the determination of the pitch frequency by the sixth means of the signals in the frequency spectrum in such time frame.

35. In a combination as set forth in claim 32, seventh means for determining the cumulative amplitudes of the signals at low frequencies in the frequency spectrum in each time frame and the cumulative amplitudes of the signals at high frequencies in the frequency spectrum in such time frame, and eighth means responsive to the determinations by the sixth and seventh means of the pitch frequency of the signals in the frequency spectrum in each time frame for refining the determination by the sixth means of the pitch frequency of the signals in the frequency spectrum in each time frame by the determination by the seventh means of the pitch frequency of signals in the frequency spectrum in such time frame.

36. In a combination as set forth in claim 35, each of the signals in the frequency spectrum in each time frame having a phase, a voice decoder, ninth means for determining the amplitudes and the phases of the signals in the frequency spectrum in each time frame, tenth means for transmitting to the voice decoder the signals representing the pitch frequency of the signals in the frequency spectrum in each time frame and the signals representing the amplitudes and phases of the signals in the frequency spectrum in each time frame, and eleventh means at the voice decoder for receiving and operating upon the transmitted signals to obtain a reproduction of the voice signals in the voice coder.

37. In a combination as set forth in claim 36, twelfth means for providing a frequency transform of the voice signals in each successive pair of time frames to produce signals in a frequency spectrum in the time frame, the signals having a pitch frequency, thirteenth means for determining the pitch frequency of the signals from the twelfth means in each successive pair of time frames in accordance with a Cepstrum analysis, fourteenth means responsive to the determination in each time frame of the pitch frequency of the signals in the frequency spectrum in each time frame by the sixth means and the determination of the pitch frequency of the signals in the frequency spectrum by the thirteenth means by the Cepstrum analysis in each successive pair of time frames for interpolating the pitch frequency in one of the time frames of such successive pair in accordance with the determination of the pitch frequency of the signals in the frequency spectrum in such successive pair of time frames by the thirteenth means by such frequency analyses, fifteenth means for determining the pitch frequency of the signals in the frequency spectrum in accordance with a harmonic gap analysis, and sixteenth means responsive to the harmonic gap analysis of the pitch frequency of the signals in the frequency spectrum in each time for refining the determination of the pitch frequency provided by the fourteenth means of the signals in the frequency spectrum for such time frame.

38. In a combination for use on voice signals in a voice coder, first means for dividing the voice signals into successive time frames, second means for providing a frequency transform of the voice signals in each time frame, third means for providing signals representing a log function of the frequency transform of the voice signals in each of the successive time frames, each of the log function signals in each time frame having an amplitude and one of the log function signals in each time frame having a particular amplitude larger than the amplitudes of the other log function signals in such time frame, fourth means for converting the log function signals in each time frame into signals having amplitudes dependent upon the amplitudes of such low function signals relative to the particular amplitude in such time frame, and fifth means for companding the signals from the fourth means.

39. In a combination as set forth in claim 38, there being a number of signals from the fifth means in each time frame, sixth means for changing the number of signals from the fifth means in each time frame to a particular number, and seventh means for obtaining a discrete cosine transform of the signals from the sixth means in each time frame.

40. In a combination as set forth in claim 39, the signals from the fifth means in each time frame constituting harmonics having different frequencies, the sixth means being operative, when the number of harmonics from the fifth means in each time frame exceeds the particular number, to eliminate every other one of the harmonics from the discrete cosine transform in each time frame at high frequencies until the particular number of signals remain in such time frame.

41. In a combination as set forth in claim 39, eighth means or converting each of the signals in the discrete cosine transform from the seventh means in each time frame into digital signals representative of the amplitudes of such signals from the seventh means wherein the number of digital signals representative of the amplitude of each of the signals from the seventh means is dependent upon the frequency of such signals.

42. In a combination as set forth in claim 41, the signals from the fifth means in each time frame having a pitch frequency and having phases, means for providing digital signals representing the pitch frequency of the signals from the fifth means in each time frame, means for providing digital signals representing the phases of the frequency signals in each time frame, a voice decoder, means for transmitting to the voice decoder the digital signals representing the companded amplitudes and the phases of the signals from the fifth means in each time frame and representing the pitch frequency of such signals, and means at the voice decoder for receiving and operating upon the digital signals transmitted to the voice decoder to obtain a reproduction of the voice signals in the voice coder.

43. In combination for use on voice signals in a voice coder, first means for dividing the voice signals into successive time frames, the voice signals in each time frame having different frequencies, second means for converting the voice signals in each time frame into frequency signals representing the different frequencies of the voice signals in such time frame, such signals having amplitudes and one of such signals in each time frame having a particular amplitude larger than the amplitudes of the other signals in such time frame, third means for emphasizing in each time frame the amplitudes of the frequency signals closer to the particular amplitude than the amplitudes of the frequency signals further away from the particular amplitude, fourth means for limiting the frequency signals at high frequencies in each time frame to reduce the frequency signals in such time frame to a particular number, fifth means for producing in each time frame signals representing a frequency transform of the frequency signals from the fourth means in such time frame, the signals from the fifth means in each time frame having amplitudes, and sixth means for converting the frequency transformed signals from the fifth means to digital signals representative of the amplitudes of such signals.

44. In a combination as set forth in claim 43, the fifth means providing a discrete cosine transform of the signals from the fourth means in each time frame, and the sixth means providing a greater number of digital signals to represent the amplitudes of the signals at low frequencies from the fifth means in each time frame than the number of digital signals to represent the amplitudes of the signals at high frequencies from the fifth means in such time frame.

45. In a combination as set forth in claim 44, seventh means for performing a harmonic gap analysis and a harmonic difference analysis on the signals from the second means in each time frame to determine the pitch frequency of such signals in such time frame, and eighth means for converting the determination of the pitch frequency for the voice signals in each time frame into digital signals representing the pitch frequency, and ninth means for converting the determination of the phases of the frequency signals from the second means in each time frame into digital signals representing such phases.

46. In a combination as set forth in claim 45 wherein a voice decoder is provided and wherein the digital signals representative of the amplitudes and phases of the frequency signals in each time frame and representing the pitch frequency in such time frame are transmitted to the voice decoder and wherein means are provided at the voice decoder for receiving such digital signals in each time frame and for operating upon such digital signals in each time frame to obtain a reproduction of the voice signals in the voice coder.

47. In a combination as set forth in claim 43, the frequency signals from the second means in each time frame having a pitch frequency and having phases, seventh means for determining the pitch frequency of the signals from the second means in each time frame, and eighth means for determining the phases of the frequency signals from the second means in each time frame.

48. In a combination as set forth in claim 47 wherein the seventh means include means for determining the pitch frequency of the frequency signals in each time frame by at least two of a Cepstrum analysis, a harmonic gap analysis, a pitch match analysis and a harmonic difference analysis.

49. In combination for use on voice signals in a voice encoder, first means for separating the voice signals into successive time frames, second means for transforming the voice signals in each successive time frame into frequency signals representative of the voice signals in such time frame, the frequency signals in each time frame having a pitch frequency and each of such signals having an amplitude and a phase, third means for determining the pitch frequency of the frequency signals in each time frame and for producing digital signals representing such pitch frequency, fourth means for determining the amplitudes of the frequency signals in each time frame and for producing digital signals representing such amplitudes, fifth means for determining the phases of the frequency signals in each time frame and for producing signals representing such phases, sixth means for determining a continuity in the phases of the frequency signals in the successive time frames, seventh means for providing signals representing a difference in the phases of the frequency signals in each time frame when the phases of the frequency signals in such time frame and in time frames immediately preceding such time frame have continuities within particular limits and for producing signals presenting such difference, eighth means for providing signals representing the phases of the frequency signals in each time frame when the phases of such frequency signals do not have continuities within the particular limits, ninth means for converting the signals representing the phases of the frequency signals in each time frame, and the differences between the phases of the signals in such time frame and in the immediately preceding time frames, into digital signals representing such phases and such predictions.

50. In a combination as set forth in claim 49, the third means including:

tenth means for determining the pitch frequency of the frequency signals in each time frame by at least two of a Cepstrum analysis, a harmonic gap analysis, a pitch match analysis and a harmonic difference analysis.

51. In a combination as set forth in claim 49, one of the frequency signals in each time frame having a particular amplitude greater than the amplitudes of the other frequency signals in such time frame, the fourth means being operative in each time frame to emphasize the frequency signals with amplitudes closer to the particular amplitude than with amplitudes further removed from the particular amplitude and to produce signals representing such emphasized amplitudes and being further operative to emphasize the amplitudes of the frequency signals at low frequencies relative to the amplitudes of the frequency signals at high frequencies.

52. In a combination as set forth in claim 49, a voice decoder, means for transmitting the digital signals from the third, fourth, and ninth means in each time frame to the voice decoder, and means at the voice decoder for receiving the transmitted digital signals in the successive time frames and for operating upon the received signals to recover the voice signals in the voice coder in the successive time frames.

53. In a combination for use in voice signals in a voice coder, first means for separating the voice signals into successive time frames, second means for transforming the voice signals in each successive time frame into frequency signals representative of the voice signals in such time frame, the frequency signals in each time frame having a pitch frequency and each of such signals having an amplitude and a phase, the frequency signals in each time frame constituting harmonics, third means for providing a determination of the pitch frequency of the frequency signals in each time frame and for producing digital signals representing such pitch frequency, fourth means for determining the frequency of each harmonic in the frequency signals in such time frame relative to individual ones of a plurality of frequency blocks and individual ones of a plurality of grids within each frequency block in such time frame, fifth means for determining the phases of the frequency signals in each time frame in accordance with the determination by the fourth means for such time frame and for producing digital signals representing such phases, sixth means for determining the amplitudes of the frequency signals in each time frame in accordance with the determinations by the fourth means for such time frame and for producing digital signals representing such amplitudes, and seventh means for transmitting the digital signals from the third, fifth and sixth means in each time frame.

54. In a combination as set forth in claim 53 wherein the third means provides the determination of the pitch frequency of the frequency signals in each time frame by providing at least two (2) of a harmonic gap analysis, a Cepstrum analysis, a pitch match analysis and a harmonic difference analysis.

55. In a combination as set forth in claim 53, the sixth means including means for limiting the frequency signals in each time frame to a particular number and including means for taking a discrete cosine transform of the limited number of the frequency signals in each time frame.

56. In a combination as set forth in claim 55, a voice decoder, and means at the voice decoder for receiving the transmitted digital signals and for processing the received digital signals to provide a recovery of the voice signals in the successive time frames in the voice coder.

57. In combination for use in a voice decoder to recover voice signals introduced to a voice coder where the voice signals are processed in the voice coder in successive time frames and where the voice signals in each time frame are subjected in the voice coder to a first frequency transform to produce frequency signals in each time frame and wherein the frequency signals in each time frame have amplitudes and a pitch frequency and where one of the frequency signals in each time frame has a particular amplitude greater than the amplitude of the other frequency signals in the time frame and where inversion signals are produced representing a difference between the particular amplitude of the one frequency signal in each time frame and the amplitudes of the other frequency signals in such time frame and where the amplitudes of the inversion signals are companded and wherein a second frequency transform is performed on the companded signals and wherein the amplitudes of the signals in the second frequency transform are converted to digital signals, first means for receiving the digital signals representing the signals in the second frequency transform in each time frame, second means for providing an inverse frequency transform of the signals from the first means in each time frame, third means for decompanding the signals from the second means in each time frame, and fourth means for inverting the decompanded signals in each time frame relative to the particular amplitude of the one frequency signal in such time frame.

58. In a combination as set forth in claim 57 wherein the frequency signals in the voice coder in each time frame constitute harmonics of the pitch frequency, and wherein after the companding operation at the voice coder, the frequency harmonics of the frequency signals in each time frame are limited or expanded in number at the voice coder to a particular number by eliminating or adding signals having high harmonics, and wherein the third means are operative to decompand the particular number of the frequency signals in each time frame, and wherein means are provided at the voice decoder for restoring the number of the frequency signals in each time frame to the number of the frequency signals in the voice coder in such time frame by eliminating or adding signals with high harmonics in accordance with the pitch frequency of the frequency signals in such time frame.

59. In a combination as set forth in claim 57 wherein the signals in the first frequency transform in each time frame at the voice coder have a pitch frequency and wherein the pitch frequency of the frequency signals in the first frequency transform in each time frame at the voice coder is determined and wherein digital signals representing the pitch frequency of the frequency signals in each time frame at the voice coder are provided and are transmitted to the voice decoder and wherein the first means receives the digital signals representing the pitch frequency of the frequency signals in each time frame and wherein fifth means are provided at the voice decoder for operating upon such received digital signals to determine the pitch frequency of the frequency signals in each time frame.

60. In a combination as set forth in claim 57 wherein the frequency signals in each time frame in the voice coder have phases and wherein signals are provided at the voice coder in each time frame to represent the phases of the frequency signals in such time frame and wherein means are provided at the voice coder for restoring the frequency signals in each time frame in accordance with the signals representing the pitch frequency of the frequency signals in such time frame and the signals representing the amplitudes and phases of the frequency signals in such time frame and wherein the signals in the first frequency transform and the restored frequency signals are compared at the voice coder to produce a plurality of signals representing the results of such comparison at different frequencies in each time frame and wherein such signals representing the results of such comparison are transmitted from the voice coder to the voice decoder in each time frame and wherein means are provided at the voice decoder for operating upon the signals representing the results of such comparison in each time frame to facilitate the restoration at the voice decoder of the voice signals in the voice coder in such time frame.

61. In a combination as set forth in claim 60 wherein successive time frames at the voice coder are overlapped and wherein the overlap in the recovered voice signals in the successive time frames is removed at the voice decoder to recover the voice signals.

62. In combination for use on voice signals in a voice coder, first means for dividing the voice signals into a plurality of successive time frame, second means operative upon the voice signals in each time frame for providing a frequency transform of such signals to produce signals in a frequency spectrum in such time frame, each of such signals in each time frame having a phase and an amplitude, third means responsive to the signals in the frequency spectrum in each time frame for producing signals representing the amplitude and phase of the signals in the frequency spectrum in such time frame, fourth means responsive to the signals from the third means in each time frame for providing a restoration of the signals in the frequency spectrum in such time frame, and fifth means responsive to the signals in the frequency spectrum from the second means and the fourth means in each time frame for comparing such signals to produce resultant signals having first or second characteristics in such time frame dependent upon the results of such comparison.

63. In a combination as set forth in claim 62 wherein the fifth means provides a plurality of frequency bills each responsive to signals in an individual range of frequencies and the fifth means compares the cumulative amplitudes of the signals from the second and fourth means with frequencies in each individual one of the frequency bins to produce for such individual frequency bin a signal having first characteristics when the cumulative amplitudes of the signals from the second and fourth means with frequencies in such individual frequency bin differ by less than a particular value and having second characteristics when the cumulative amplitudes of the signals from the second and fourth means with frequencies in such individual frequency bin differ by at least the particular value.

64. In a combination as set forth in claim 63, the signals in the frequency spectrum in each time frame having a pitch frequency, sixth means for producing in each time frame signals representing the pitch frequency of the signals in the frequency spectrum in such time frame, and seventh means for transmitting in each time frame the signals representing the pitch frequency of the signals in the frequency spectrum in such time frame, the signals having the first and second characteristics for the frequency bins in such time frame and the signals from the third means for such time frame.

65. In a combination as set forth in claim 64, the seventh means including eighth means for converting into binary signals the signals representing the pitch frequency of the signals in the frequency spectrum in each time frame, the signals having the first and second characteristics for the frequency bins in such time frame and the signals from the third means for such time frame, the seventh means being operative to transmit the binary signals.

66. In a combination as set forth in claim 65, a voice decoder, and means at the voice decoder for receiving the transmitted binary signals in each time frame and for operating upon the received signals in such time frame to recover the voice signals in such time frame in the voice coder.

67. In a combination as set forth in claim 62, the signals in the frequency spectrum in each time frame having a pitch frequency, sixth means for producing in each time frame signals representing the pitch frequency of the signals in the frequency spectrum in such time frame.

68. In combination for use on voice signals in a voice coder, first means for providing the voice signals into a plurality of successive time frames each having an overlapped relationship to the time frames immediately preceding and immediately following such time frame, second means for providing a frequency transform on the voice signals in each time frame to produce signals in a frequency spectrum in such time frame, the signals in the frequency spectrum in each time frame having a pitch frequency and each of the signals having an amplitude and a phase, third means for limiting the signals in the frequency spectrum in each time frame to a particular number, fourth means for providing a discrete cosine transform of the particular number of the signals in the frequency spectrum in each time frame, fifth means responsive to the discrete cosine transform for each time frame for reconstructing the signals in the frequency spectrum in that time frame, sixth means for providing in each time frame a plurality of signals individually having first and second characteristics dependent upon the amplitudes of the signals from the second means and the fifth means in different portions of the frequency spectrum in such time frame, seventh means for providing signals representing the amplitudes and the phases of the signals in the frequency spectrum in each time frame, and eighth means for providing signals representing the pitch frequencies of the signals in the frequency spectrum in each time frame.

69. In a combination as set forth in claim 68, means for predicting the phases of the signals in the frequency spectrum in each time frame from the phases of the signals in the frequency spectrum in the time phases immediately preceding such time frame and for providing signals representing the difference between the phases of the signals in the frequency spectrum in such time frame and the phases of the signals in the immediately preceding time frames when such predictions are within particular limits and for providing signals representing the phases of the signals in the frequency spectrum in such time frame when such predictions are greater than such particular limits.

70. In a combination as set forth in claim 68, the sixth means including ninth means for comparing the cumulative amplitudes of the frequency signals from the second means and the fifth means in each of a plurality of frequency bins in each time frame and for producing for each frequency bin in each time frame a signal having first characteristics for first results in such comparison and having second characteristics for second results different from the first results in such comparison and the sixth means including tenth means for transmitting the signals from the seventh, eighth and ninth means in each time frame.

71. In a combination as set forth in claim 70, means for converting the signals from the seventh, eighth and ninth means into binary signals and for transmitting, for each frequency in the frequency spectrum in each time frame, a greater number of binary signals for low frequencies than for high frequencies in representation of the amplitudes and phases of the frequency signals in the frequency spectrum in such time frame.

72. In a combination as set forth in claim 71, a voice decoder, and means at the voice decoder for receiving the transmitted binary signals in each time frame and for operating upon the received signals in each time frame to obtain a recovery of the voice signals in the voice coder in such time frame.

73. In combination for use on voice signals in a voice coder, first means for dividing the voice signals into successive time frames, second means for converting the voice signals into frequency signals in a frequency spectrum in each time frame, each of such frequency signals having an amplitude and a phase, third means for providing in the frequency spectrum a frequency pattern represented by blocks and grids within each block, fourth means for determining the particular block and grid in which the frequency of each of the frequency signals in the frequency spectrum in each time frame is located, and fifth means for producing signals representing the amplitudes and phases of the frequency signals in the frequency spectrum in each time frame in accordance with the determinations provided by the fourth means.

74. In a combination as set forth in claim 73 wherein the fifth means includes sixth means for providing signals representing the difference between the phases of the frequency signals in the frequency spectrum in each time frame and the phases of such frequency signals in the frequency spectrum in time frames immediately preceding such time frame when such differences are within limits predicted from the phases of the frequency signals in such time frame and such immediately preceding time and for providing signals representing the phases of the frequency signals in the frequency spectrum in each time frame when such phase difference is greater than such predicted limits.

75. In a combination as set forth in claim 73, the fifth means including sixth means for determining the amplitudes of the frequency signals in the frequency spectrum in each time frame and for determining a particular amplitude in such frequency signals greater than the amplitudes of the other frequency signals in the frequency spectrum in such time frame and for producing signals in the frequency spectrum in each time frame representing the difference between such particular amplitude and the amplitudes of the frequency signals in the frequency spectrum in such time frame.

76. In a combination as set forth in claim 73, the fifth means including sixth means for providing signals representing a logarithm of the amplitudes of the frequency signals in the frequency spectrum in each time frame, the logarithm signals in each time frame having amplitudes, the fifth means including seventh means for determining the amplitudes of the logarithm signals in each time frame and for determining a particular amplitude in such logarithm signals in each time frame greater than the amplitudes of the other logarithm signals in such time frame and for producing signals in each time frame representing the difference between such particular amplitude and the amplitudes of the logarithm signals in such time frame.

77. In a combination as set forth in claim 76, the fifth means including eighth means for providing signals representing the difference between the phases of the frequency signals in the frequency spectrum in such time frame and the phases of such frequency signals in the frequency spectrum in the time frames immediately preceding such time frame when such differences are within limits predicted from the phases of the frequency signals in such time frame and such immediately preceding time frames and for providing signals representing the phases of the frequency signals in the frequency spectrum in each time frame when such phase difference is greater than such predicted limits, ninth means for converting the signals from the eighth and ninth means in each time frame into binary signals in such time frame, and tenth means for transmitting the binary signals in each time frame.

78. In combination for use on voice signals in a voice coder, first means for separating the voice signals into successive time frames, second means for providing a frequency transform of the signals in each time frame to provide frequency signals in a frequency spectrum in each time frame, each of the frequency signals in each time frame having an amplitude and a phase, third means for limiting the frequency signals from the second means to a particular range of frequencies, fourth means for determining the pitch frequency of the frequency signals in each time frame, fifth means for defining a plurality of frequency blocks and a plurality of frequency grids for each frequency block in the particular range of frequencies limited by the third means, sixth means for determining the frequency of each of the frequency signals in the particular range of frequencies in each time frame in accordance with the determination of the pitch frequency of such frequency signals by the fourth means and the particular one of the blocks, and the particular one of the grids in such block, in which such frequency signal is located, and seventh means responsive to the frequency determined for each of the frequency signals in the particular range in each time frame for producing signals representing the amplitude and phase of such frequency signal.

79. In a combination as set forth in claim 78, one of the frequency signals in the particular range in each time frame having a particular amplitude larger than the amplitudes of the other signals in the particular range in such time frame, and eighth means for providing in each time frame signals having amplitudes representing a difference between the particular amplitude and the amplitudes of the frequency signals in the particular range in such time frame.

80. In a combination as set forth in claim 79, ninth means for providing a discrete cosine transform of the amplitude signals provided by the signals means in each time frame, tenth means for operating upon the signals from the discrete cosine transform in each time frame to provide a frequency restoration of the frequency signals in each time frame, and eleventh means for comparing the signals at the different frequencies from the second and tenth means in each time frame to provide in such time frame signals dependent upon the results of such comparison.

81. In a combination as set forth in claim 80, the eleventh means being operative to produce signals having first characteristics for different frequencies in each time frame when the relative amplitudes of the signals from the second and tenth means in such different frequencies in such time frame are within particular limits and having second characteristics for such different frequencies in such time frame when the relative amplitudes of the signals from the second and tenth means in such different frequencies in such time frame are outside of such particular limits.

82. In combination in a voice decoder for restoring voice signals coded in a voice coder where the coded signals are provided for successive time frames and the coded signals in each successive time frame are subjected to a frequency transform and the frequency transformed signals in each time frame are represented by a plurality of binary signals indicating the pitch frequency, the amplitudes and the phases in a particular range of frequencies in such time frame and by a plurality of binary signals indicating the accuracy, or lack of accuracy, of the cumulative amplitudes of the frequency transformed signals in progressive frequency bins n the particular frequency range and where the binary signals are transmitted from the voice coder to the voice decoder, first means at the voice decoder for receiving the transmitted signals in each time frame, second means at the voice decoder for operating upon the received signals indicating the pitch frequency, the amplitudes and the phases of the received signals in each time frame to restore the frequency transformed signals in such time frame, third means at the voice decoder for retaining, in individual frequency bins in each time frame, the amplitudes of the restored frequency signals in such frequency bins in accordance with the signals indicating an accuracy in the amplitudes of the frequency signals in such frequency bin and for providing, in other frequency bins in such time frame, the average of the amplitudes of the frequency signals in such frequency bins in such time frame in accordance with the signals indicating an inaccuracy in the amplitudes of the frequency signals in such frequency bins, and means for providing an inverse frequency transform of the frequency signals from the third means in each time frame to restore the frequency signals in that time frame.

83. In a combination as set forth in claim 82 wherein the coded signals representing the phases of the frequency signals in each time frame at the voice coder indicate a predicted difference in the phases of the frequency signals in each time frame for continuities greater than a particular value in the phases of such frequency signals in such time frame and in immediately preceding time frames and indicate the phases of the frequency signals in such time frame for continuities less than the particular value in such time frames and in the immediately preceding time frames, and wherein the third means at the voice decoder are responsive to the coded signals indicating the phases, and the predicted differences in the phases, of the frequency signals in each time frame to determine the phases of the frequency signals in such time frame.

84. In a combination as set forth in claim 83 wherein a greater number of binary signals is provided in each time frame to represent the amplitudes of the frequency signals of lower frequency in such time frame than the amplitudes of the frequency signals of higher frequency in such time frame and wherein the third means at the voice decoder is responsive to the number of the binary signals representing the amplitudes of the frequency signals in each time frame in reproducing the frequency signals in such time frame and wherein fourth mans are provided at the voice decoder for restoring the voice signals from the voice signals in the successive time frames from the third means.

85. In a combination as set forth in claim 82 wherein a greater number of binary signals is provided in each time frame to represent the phases of the frequency signals of lower frequency in such time frame than the phases of the frequency signals of higher frequency in such time frame and wherein the third means at the voice decoder is responsive to the number of the binary signals representing the phases of the frequency signals in each time frame in reproducing the frequency signals in such time frame.

86. In combination in a voice decoder for restoring voice signals coded in a voice coder where the coded signals are provided for successive time frames and the coded signals in each successive time frame are subjected to a frequency transform and the frequency transformed signals in each time frame are limited to a particular number by eliminating alternating ones of the frequency transformed signals at the high frequency end of the frequency transform in each time frame and wherein the limited number of the frequency transformed signals in each time frame are represented by a plurality of binary signals indicating the pitch frequency, the amplitudes and the phases of the limited number of the frequency transformed signals and wherein the binary signals are transmitted from the voice coder to the voice decoder, first means at the voice decoder for receiving the transmitted signals in each time frame, second means at the voice decoder for operating upon the received signals indicating the pitch frequency, the amplitudes and the phases of the received signals in each time frame to restore the frequency transformed signals in such time frame, third means responsive at the voice decoder to the binary signals representing the pitch frequency of the frequency signals in each time frame for restoring the frequency signals eliminated at the high frequencies at the voice coder, fourth means for providing an inverse frequency transform on the signals from the third means to recover the voice signals in each time frame, and fifth means for combining the signals in the successive time frames to restore the voice signals provided at the voice coder.

87. In a combination as set forth in claim 86, wherein the coded signals representing the phases of the frequency signals in each time frame at the voice coder indicate a predicted difference in the phases of the frequency signals in such time frame for continuities greater than a particular value in the phases of such frequency signals in such time frame and in immediately preceding time frames and indicate the phases of the frequency signals in such time frame for continuities less than the particular value in such time frame and in the immediately preceding time frames, and the second means at the voice decoder are responsive to the coded signals indicating the phases, and the predicted differences in the phases, of the frequency signals in each time frame to determine the phases of the frequency signals in such time frame.

88. In a combination as set forth in claim 86 wherein a greater number of binary signals is provided in each time frame to represent the frequency signals or lower frequency in such time frame than the frequency signals of higher frequency in such time frame and wherein the second means at the voice decoder is responsive to the number of the binary signals representing the phases, and the differences in the phases, of the frequency signals in each time frame in reproducing the frequency signals in such time frame.

89. In a combination as set forth in claim 88, wherein the successive time frames are overlapped and wherein the fifth means eliminates the time overlaps in the successive time frames in restoring the voice signals provided at the voice decoder.

90. In a combination as set forth in claim 89 wherein the coded signals representing the phases of the frequency signals in each time frame at the voice coder indicate a predicted difference in the phases of the frequency signals in each time frame for continuities greater than a particular value in the phases of such frequency signals in such time frame and in the immediately preceding time frames and indicate the phases of the frequency signals in such time frames for continuities less than the particular value in such time frames and in the immediately preceding time frames, and wherein the third means at the voice decoder are responsive to the coded signals indicating the phases, and the predicted differences in the phases, of the frequency signals in each time frame to determine the phases of the frequency signals in such time frame.

91. In a combination as set forth in claim 90 wherein the signals representing the amplitude differences in each time frame are companded and wherein means are provided at the voice decoder for decompanding the companded signals and wherein a greater number of binary signals is provided in each time frame to represent the phases, and the differences in the phases, of the frequency signals of lower frequency than the frequency signals of higher frequency in such time frame and wherein the third means at the voice decoder is responsive to the number of the binary signals representing the phases, and the differences in the phases of the frequency signals in each time frame in reproducing the frequency signals in such time frame.

92. In combination for use in a voice decoder to recover voice signals introduced to a voice coder where the voice signals are processed in the voice coder in successive time frames and where the voice signals in the voice coder are subjected to a frequency transform to produce frequency signals in each time frame and where the frequency signals in each time frame have a pitch frequency, an amplitude and a phase and where logarithms are provided for the amplitudes of the frequency signals in each time frame and where the relative amplitudes of the logarithmic signals in each time frame are determined to define the amplitude with the highest value in such time frame and wherein the differences between the highest amplitude value and the amplitudes of the frequency signals in such time frame are determined and wherein such amplitude differences for the frequency signals in such time frame are converted to binary signals and wherein the binary signals are transmitted by the voice coder, first means at the voice decoder for receiving the transmitted binary signals, second means at the voice decoder for operating upon the received signals to convert the difference amplitudes to frequency signals having the logarithmic amplitudes provided at the voice coder, third means at the voice decoder for converting the logarithmic signals in each time frame to the frequency signals provided in such time frame at the voice coder, and fourth means at the voice decoder for operating upon the signals from the third means for each time frame and the signals representing the pitch frequency and the phases of the frequency signals in each time frame for restoring the voice signals in each time frame.

93. In a combination as set forth in claim 92 wherein the signals representing the amplitude differences in each time frame are companded and wherein means are provided at the voice decoder for decompanding the companded signals.

* * * * *